US011124391B2

(12) United States Patent
Clive-Smith et al.

(10) Patent No.: US 11,124,391 B2
(45) Date of Patent: Sep. 21, 2021

(54) LIFTING SHIPPING CONTAINERS

(71) Applicant: BLOK Container Systems Limited, Warwick (GB)

(72) Inventors: Martin Clive-Smith, Leek Wootton (GB); Edward Henry Reynolds, Orlingbury (GB)

(73) Assignee: BLOK Container Systems Limited, Warwick (GB)

( * ) Notice: Subject to any disclaimer, the term of this patent is extended or adjusted under 35 U.S.C. 154(b) by 44 days.

(21) Appl. No.: 16/485,857

(22) PCT Filed: Feb. 8, 2018

(86) PCT No.: PCT/GB2018/000021
§ 371 (c)(1),
(2) Date: Aug. 14, 2019

(87) PCT Pub. No.: WO2018/150153
PCT Pub. Date: Aug. 23, 2018

(65) Prior Publication Data

US 2020/0055711 A1 Feb. 20, 2020

(30) Foreign Application Priority Data

| | | |
|---|---|---|
| Feb. 17, 2017 | (GB) | 1702669 |
| Jul. 6, 2017 | (GB) | 1710914 |
| Nov. 27, 2017 | (GB) | 1719694 |

(51) Int. Cl.

| | |
|---|---|
| ***B66C 1/10*** | (2006.01) |
| ***B66C 1/66*** | (2006.01) |
| ***B66C 13/22*** | (2006.01) |

(52) U.S. Cl.
CPC ..... *B66C 1/104* (2013.01); *B66C 1/663* (2013.01); *B66C 13/22* (2013.01)

(58) Field of Classification Search
CPC ..... B66C 1/104; B66C 1/663; B66C 1/10; B66C 1/101; B66C 1/102; B66C 1/105; B66C 13/22; B66C 13/20
See application file for complete search history.

(56) References Cited

U.S. PATENT DOCUMENTS 3,767,250 A * 10/1973 Ward ..... B66C 1/663 294/81.21
4,244,615 A * 1/1981 Brown ..... B63B 25/004 294/81.1

(Continued)

FOREIGN PATENT DOCUMENTS

| | | |
|---|---|---|
| CN | 1437558 | 8/2003 |
| CN | 1659096 | 8/2005 |

(Continued)

OTHER PUBLICATIONS

International Search Report and Written Opinion issued in application No. PCT/GB2018/000021 dated Apr. 30, 2018.

(Continued)

*Primary Examiner* — Glenn F Myers
(74) *Attorney, Agent, or Firm* — Troutman Pepper LLP; Ryan Schneider; Korbin Blunck

(57) ABSTRACT

An adaptor including a pair of lifting beams for lifting two or more shipping containers in a side by side configuration, each container having corner fittings provided with lifting/fastening sockets. Each lifting beam is designed to extend across one end of the top of the containers to be lifted and has pairs of connectors designed to connect to the lifting sockets provided in the tops of the containers. Each lifting beam, or connecting beams extending between the lifting beams, have sockets for detachable connection with an associated crane or lifting machine to lift the adaptor and containers. Each lifting beam is also a continuous extend- (Continued)

able component having first and second portions which are movable relative to each other.

28 Claims, 19 Drawing Sheets

(56) References Cited

U.S. PATENT DOCUMENTS

| | | | | |
|---|---|---|---|---|
| 4,471,989 | A * | 9/1984 | Taylor | B66C 1/101 294/81.21 |
| 7,690,707 | B2 | 4/2010 | Stinis et al. | |
| 9,988,246 | B2 * | 6/2018 | Illana Martos | B65D 90/0013 |
| 2003/0168871 | A1 * | 9/2003 | Geis | B66C 1/663 294/81.21 |
| 2003/0189348 | A1 | 10/2003 | Lindstrom | |
| 2005/0225104 | A1 * | 10/2005 | Lim | B66C 1/102 294/81.1 |
| 2006/0006338 | A1 | 1/2006 | D'Emilio et al. | |
| 2007/0296228 | A1 * | 12/2007 | Mills | B66C 1/104 294/81.1 |
| 2010/0109359 | A1 * | 5/2010 | Mills | B66C 1/104 294/81.2 |
| 2011/0120968 | A1 * | 5/2011 | Stinis | B66C 1/101 212/276 |
| 2012/0212004 | A1 * | 8/2012 | Karlsson | B66C 1/102 294/81.1 |
| 2012/0267452 | A1 * | 10/2012 | Ng | B66C 13/14 239/273 |
| 2014/0312638 | A1 * | 10/2014 | Ng | B65G 65/23 294/86.4 |

FOREIGN PATENT DOCUMENTS

| | | | |
|---|---|---|---|
| CN | 2761556 | Y | 3/2006 |
| CN | 204980918 | | 1/2016 |
| CN | 105880989 | A | 8/2016 |
| CN | 205500547 | | 8/2016 |
| EP | 1521716 | A1 | 4/2005 |
| EP | 1939131 | A2 | 7/2008 |
| JP | S6093677 | U | 6/1985 |
| WO | 03099699 | A1 | 12/2003 |
| WO | 2017141005 | A1 | 8/2017 |

OTHER PUBLICATIONS

Office Action from Application No. 201880012460.2 dated Aug. 4, 2020 (with English translation) (17 pages).
Search Report from Application No. 201880012460.2 dated Jul. 27, 2020 (English translation) (1 pages).

* cited by examiner 71
73
1
2
2'
4
5
6
8
9
9'
9''
10
10'
10''
11
50
74
74''
89
G
A
A'
22'
22''

58
232
220
230
57
227
228
226
65
46
229
221
225
59
224
223
222
60

58
57
227
228
226
65
223
230
46'
221
224
223
224
222
225
60

LIFTING SHIPPING CONTAINERS

This invention relates to systems for lifting shipping containers during loading and unloading ships and vehicles using cranes and lifting machines fitted with lifting spreader arrangements. There are 4 common types of spreader arrangement. Each of these is connected to the crane via a head block or frame which carries pulleys around which are threaded wire ropes lifting the head block and spreader and its load up to hoists mounted on the structure of the crane. Head Blocks form a major part of the crane machinery, and typically spreaders are removable from the head blocks albeit being a time consuming exercise. Ideally in normal operation it is not desirable to change spreaders during an operating shift because of the complexity and manual skill needed.

Spreaders, mostly single spreaders, can also be fitted to other types of handling machines such as jib cranes, gantry cranes, fork trucks, straddle carriers, and reach stackers which have known hydraulic head block connections to the spreaders for their operation.

For example, a single container can be lifted by rectangular frame or single spreader suspended from a crane the spreader having connectors connecting to sockets in top corner fittings of the container. They can be longitudinally telescopic enabling containers of different lengths, most commonly 20 ft and 40 ft in length, to be top handled.

Two such spreaders can be located side by side and connected by arms and links and control systems mounted on a main frame itself suspended by the head block of a container crane and are thus able to lift two containers positioned side by side horizontally such assemblies being known as tandem lift spreaders.

Another type of spreader known as a twin-lift spreader comprises a single rectangular frame spreader able to lift two 20 ft containers aligned longitudinally end to end or a single 40 ft or 45 ft long container. When lifting two 20 fts, the spreader is arranged to be telescopic longitudinally and pick up each container separately and displace the two containers apart longitudinally on deck or inside the hold of a ship or on a road trailer.

There is also known a tandem twin lift spreader arrangement that combines the side by side tandem and longitudinal twin lifting arrangements and can pick up four 20 ft containers as two pairs of longitudinally aligned containers in a side by side configuration. This arrangement essentially comprises two twin lift spreader arrangements located and controlled side by side suspended by a main frame and thence to the head block in a heavy and structurally demanding arrangement.

Whilst such multi-container lifting arrangements are reasonably effective in use they suffer from the problem that they are massively heavy so that a crane having a capacity to lift 100 tonnes is needed to lift two 30 tonne of containers because of the weight of the lifting spreader arrangement can reach some 40 tonnes before considering payload. Very few 100 tonne cranes and the quayside construction needed to support them exist. So although there is a need to lift more containers at a time, few ports have the capacity to do it.

Not all containers are laden to full capacity of say 34 tonnes gross. Indeed 20% of containers are shipped worldwide empty at only 4 tonnes gross. Of the laden containers, many weigh less than 20 tonnes gross. Most ports have therefore invested in single spreader lifting arrangements able to lift 34 tonnes even though they would like to lift more than one container at a time, and could do so but for the massively heavy tandem lift spreader arrangements requiring very expensive stronger quays and cranes. The cost of a 100 tonne crane, spreaders and quay reinforcements runs to some $20 million per installation so most ports are therefore restricted to loads of a maximum of 60 tonnes.

Some ports use straddle carriers to move the containers around on land particularly from the ship to shore crane to the storage zone. These are typically only wide enough to straddle one container width but not more. So if a tandem lift spreader places two containers on a quayside, the containers must be parted side by side some 1.5 m to allow the straddle carrier to pick them up.

Speed of operation is essential for efficient and commercially viable operation. It is often the case that a single container needs to be lifted by itself and if a Tandem lift spreader is being used, it must be taken back to the quayside and swapped for a single spreader taking up valuable time. Connections between crane power supply and the spreader must be made. Storage of the additional or replacement spreaders must be stored on the valuable quayside further reducing crane efficiency.

It is an object of the present invention to provide an arrangement for lifting containers which addresses at least some of the above issues.

The present invention thus provides an adaptor comprising a pair of lifting beams for lifting two or more shipping containers in a side by side configuration, each container having corner fittings provided with lifting/fastening sockets, each lifting beam being designed to extend across one end of the top of the containers to be lifted and having pairs of connectors designed to connect to the lifting sockets provided in the tops of the containers, each lifting beam, or connecting beams extending between the lifting beams, having sockets for detachable connection with an associated crane or lifting machine to lift the adaptor and containers, each lifting beam also being a continuous extendable component having first and second portions which are movable relative to each other and actuator means connected between these beam portions so that the portions can be moved relative to each other to vary the effective length of each lifting beam to enable different numbers of containers to be lifted in a side by side configuration beneath the lifting beam or the spacing between the containers to be varied at one or both ends of the containers. Conveniently the first portion of the beam may be located centrally and the second portion comprises two second portions which project beyond the respective ends of the first portion and are movable telescopically relative to the central first portion by the actuator means.

The second portion slides relative to the first portion on bearings comprising low friction support blocks or rollers or a combination of both. Use of these low friction support blocks greatly eases the friction which would otherwise occur. The blocks may be made of a very low friction plastic compound with a coefficient of friction of say less than 0.15 and operate dry without any grease or lubricant The actuator means for moving the second portion of the beam relative to the first portion may comprises a mechanical drive such as screw jacks, rack and pinion gears or chain drives or may comprise one or more hydraulic rams, the mechanical drives being powered electrically and/or hydraulically. The actuator means may be controlled electronically to coordinate their locations relative to each other and the adaptor in general.

The connectors on the lower surface of the beam which are designed to connect with the lifting sockets in the tops of the containers may be vertically displaceable relative to the beam to pick up containers whose tops are at modestly different due to general construction tolerances and operational conditions resulting in differential heights of up to 100 mm.

In such an arrangement two or more of the connectors in the lower surface of the beam may conveniently be vertically displaceable into the beam against spring loading or gravity, the connectors once connected to the containers moving out of the beam when the containers are lifted to level off the tops of the lifted containers. Other connectors might be in fixed location to the first or second portion of the beam in particular the outermost connectors.

Further, the connectors in the lower surface of the beam may each be provided with a vertically disposed shaft on the bottom end of which is a locking head, the shaft being rotatable to lock the locking head into the lifting socket of the container to be lifted, the shaft being provided with a projection which contacts a formation on a vertically movable blocking pin which also projects downwardly from the lower surface of the beam to block rotation of the locking head when the projection is in contact with the formation, the blocking pin being positioned relative to the locking head so that when the locking head is received in the socket the blocking pin is displaced vertically against spring loading by contact with an upper surface of the socket so that the formation moves out of contact with the projection to allow rotation of the locking head within the socket.

Further connectors can be mounted on arms allowing them to be displaced substantially vertically up and down against springs acting on the arms. The arms can be fixed to the beam via pivots or can be allowed to lift up and down and tilt with the location of the connectors controlled by vertical slots that they are free to move up and down in. Such connectors may have mounted within their housings blocking pins that move with the connectors vertically but which when encountering the top of a container socket are plunged up inside the housing to allow the head of the connector to be rotated.

Where the connectors of the second portion are fixed to the second portion, the weight of the adaptor can press the connectors through gravity into the aligned sockets on the containers as the first portion bears on the second portion.

The actuator means can move adjacent containers apart to, for example, allow gaps between hatch covers or projecting items to be avoided when containers are being loaded or unloaded or to avoid cell guides when loading in ships or to allow an additional container making 3 or more containers to be lifted where additional connectors have been provided on the first portion to enable the additional container to be lifted by the first portion between the parted containers, or allow a container to be straddled between two parted containers.

A movable balance weight can be provided which can be moved relative to the beam to balance the beam if containers of different weights or in non-symmetrical positions are to be lifted by the beam. The connectors for the containers to be lifted can be provided with weight sensors which report to a beam control system which works out where the balance weight needs to move to in order to balance the beam for lifting and actions this move. Movement of the weight can be coordinated via the control centre with movement of the second portions so that the head block remains located at the combined centre of mass of containers, beams and balance weight.

The upper surface of the adaptor can have lifting sockets or pins for connection with the lifting frame or spreader for raising by the crane or lifting machine. Where the spreader uses known twistlock connectors a number of additional sockets may be provided so that for off-set loading on the beam, the spreader can be displaced to one side or the other to enable the centre of mass of the lifting of the beams and containers to arrive under the spreader. Alternatively a socket might be formed as an extended slot along which the connectors of the spreader can be moved to locate the spreader over the centre of mass of the beams and containers. Furthermore the sockets could be moveable by integral actuators mounted in or on the beams to displace them to a balanced position over the centre of mass.

Where the beams are stand alone assemblies they can be connected to a known spreader with one beam at each end of the spreader. If the spreader is as is typically longitudinally telescopic, then as the spreader telescopes from say a 20 ft container length position to a 40 ft length, it can carry with it the beams ready to locate with two or more 40 ft containers. Likewise where the adaptor has longitudinally orientated connecting beams connecting the beams at each end to each other and these connecting beams are made telescopic then as the spreader telescopes from say a 20 ft container length position to a 40 fts length, it can carry with it the beams ready to locate with two or more 40 ft containers.

The connecting beams may be extendable and may be provided with auxiliary connectors designed to connect to lifting sockets in the top of a container or the top container in a column of containers so that the connecting beams can be extended to move the lifting beam apart beyond the length of the container or column of containers allowing the container or column of containers to be lifted by the auxiliary connectors in a transversely balanced central position. Spreaders are commonly set up with extension stops set at 20 ft, 40 ft and 45 ft so the auxiliary connectors on the connecting beams can be set at a 40 ft length location when the spreader is extended to its 45 ft position. Other extensions at 30 ft, 35 ft, 38 ft might be so arranged.

The connecting beams although conveniently shown as two could be made a single beam fixed or telescopic.

Whereas known spreaders are connected to the head blocks midway along their longitudinal connecting beams the present invention can have its lifting beams connected directly to the twistlocks of the parent spreader resulting in the connector beams being only lightly loaded during use and thus can be lightweight. The connecting beams and lifting beams may be made as sub-assemblies able to be shipped inside a standard container for delivery to a port and once delivered can be assembled using fasteners and/or welding. The length of the connecting beams is truncated to fit in the standard container.

Measuring means may be provided to measure the gap between the containers before they are lifted and to enable the gap between containers to be adjusted by the actuator means to a required value. Typical gaps are anything from zero to 2.5 m but preferably limited to 1.5 m to accommodate straddle carriers, 450 mm where gaps between hatch covers are needing to be bridged and between 25 mm and 200 mm where cell guides need to be accommodated.

Having loaded or unloaded the containers on the ship the spreader can place the beams on a surface or indeed the top of other containers and release its connectors independently from the beams and without there being any operation action necessary to be performed by the beams and their mechanisms. Preferably no power connections need be released (or connected) to the spreader releasing of the spreader being simply a matter of it unlocking its own connectors from the adaptor.

Although the second portion of the beam can be mounted for sliding motion from inside the first portion to telescope in and out, it could be located outside the first portion or underneath or on the outermost side. Where it is on the outside of the first portion, the structure of the second portion can be relieved on the inboard side to make space for connecting beams to connect directly to the first portion.

Where the adaptor is required to be lowered into the hold of a ship having cell guides, the cell guides project longitudinally between the containers for a distance of up to 500 mm. The second portions are thus deployed side to side to make a gap between the containers of say 25 mm to 200 mm to receive the cell guides between them and the first portions are shaped to provide a slot preferably some 200 mm wide by 500 mm deep to enable the lifting beams to pass by the cell guides.

The present invention will now be described, by way of example only, with reference to the accompanying drawings in which.

Figures 1A, 1B, 1C:
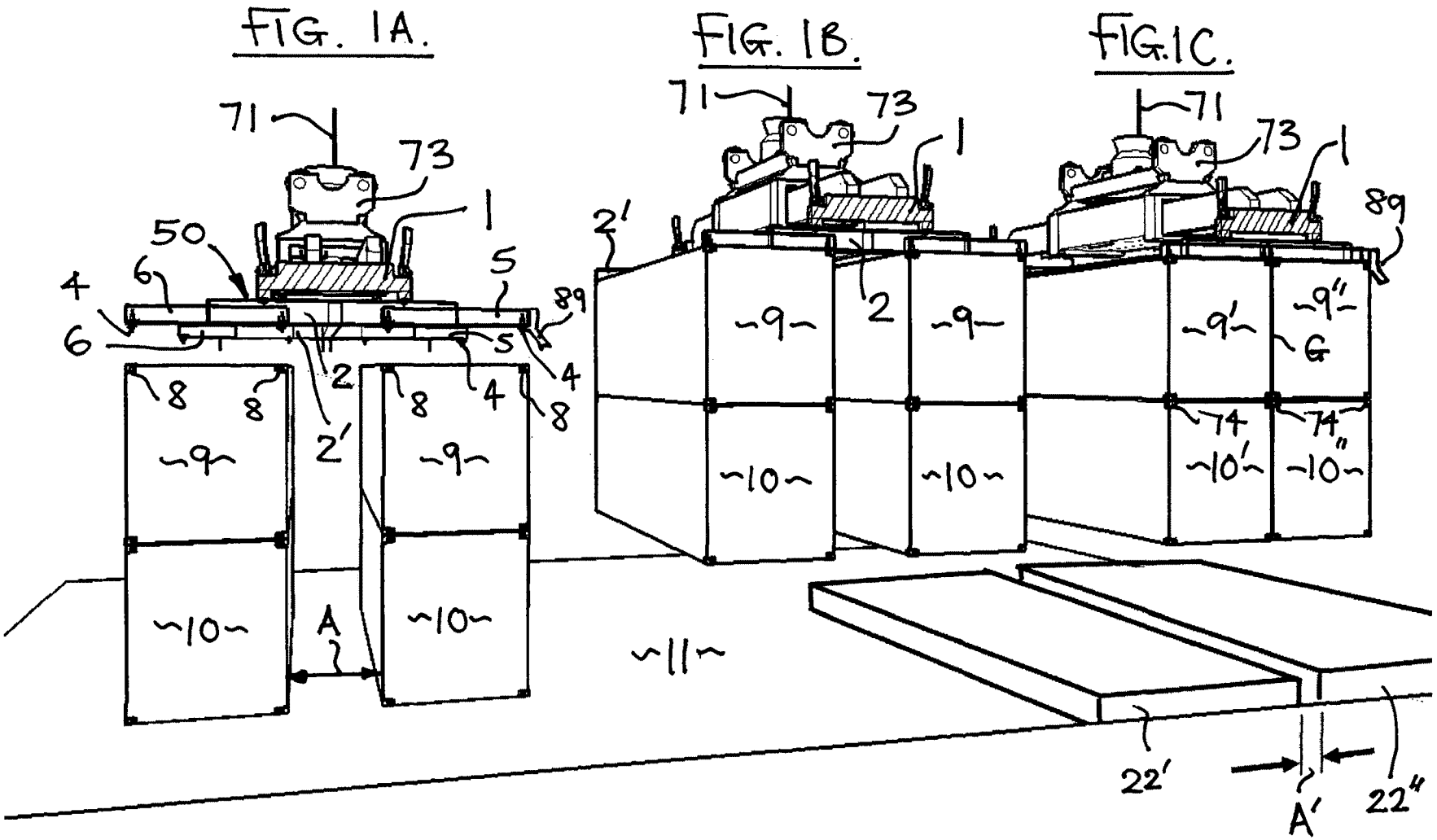
FIGS. 1A to 1C show perspective views of a container lifting adaptor in accordance with the present invention in use lifting columns of shipping containers.

In FIG. 1A there is seen a perspective view of known single lift parent spreader 1 attached to a lifting adaptor 50 (better seen in FIG. 2A) which includes two lifting beams 2 and 2' at the front and rear of the adaptor. In accordance with the present invention the beams 2, 2' are telescopic with a central first portion 7 and two outer second portions 5 and 6. Second portions 5 and 6 have connectors 4 projecting down from the second portions 5 and 6. Each of the connectors 4 is shown in FIG. 1A about to twist lock into known elongate sockets or top lift apertures (not illustrated) in the top face of corner fittings 8 of the containers 9, seen stacked on similar containers 10 resting on ground 11. The stacks of containers 9, 10 are spaced apart to provide a gap 12 denoted by arrow A. The gap enables a known wheeled gantry crane or straddle carrier to drive one of its legs between the stacks of containers 9, 10.

In FIG. 1B the connectors 4 are twist locked into the sockets of top fittings 8 of the containers 9 which are thus able to be lifted off the ground via spreader 1, head block 73 and hoist wire 71 hoisted by a typical container crane (not shown). In this example the container 9 and 10 are connected together vertically by known twistlocks 74 one at each of the four mating corners of each container to enable them to remain together and be lifted as one. Since there are two stacks making four containers in all being lifted in this example it is important to note that these containers have substantially the same weight either because they are empty and of known weight, or if loaded are then loaded to a known weight which is now required by international law to be noted and controlled. Since the weights are tolerably the same for each container or stack under second portions 5, 6, the load is balanced under the wires 71 and can be lifted vertically without undue tilting of the assembled load.

Once off the ground then, as shown in FIG. 1C, the second portion 5, 6 are retracted so that the containers 9', 9" and 10', 10" come close together closing the gap 12 to a small gap G of typically 25 mm. Sited below the containers are illustrated typical hatch covers 22', 22" which form the deck over the cells of container ships. Such hatch covers are typically spaced apart by a gap A' denoted by the arrows of perhaps 200 mm or more depending on the ship support structure to which this example is being directed. To locate the columns of containers 9' and 10' on hatch 22' and columns of containers 9" and 10" on hatch 22", the containers must be moved apart sideways to correspond to gap A', this being achieved by extending the second portions second portion 5, 6 (as described below) from which the containers are suspended.

Figure 2A:
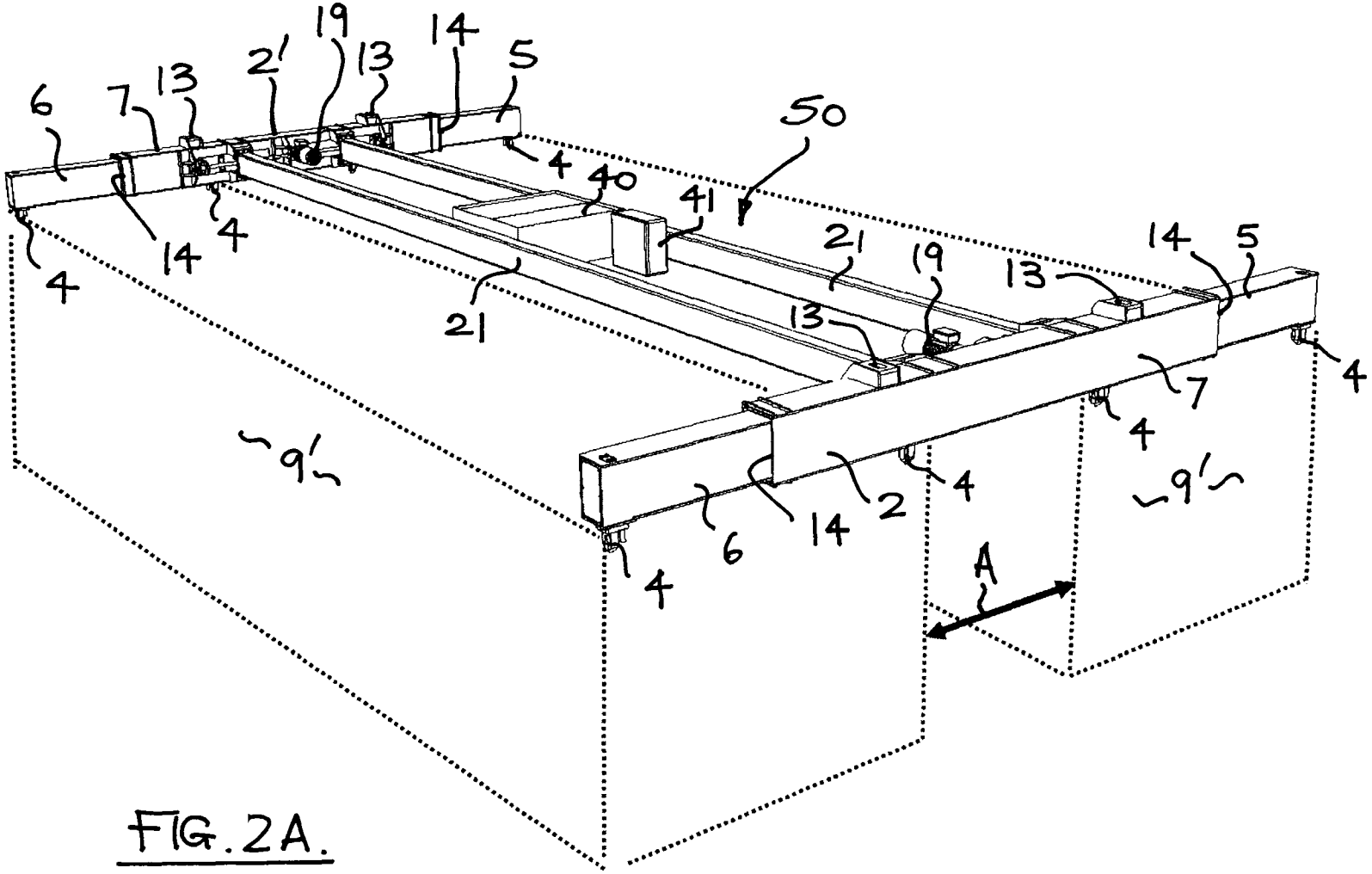
FIG. 2A shows a perspective view of a lifting adaptor of FIGS. 1A to 1C in more detail.

FIG. 2A shows in perspective view one arrangement of the adaptor 50 comprising beams 2, 2' with their second portions second portion 5, 6 in an extended position from first portion 7. The parent spreader 1 not shown in this figure has been removed from its engagement with aperture plates 13 in beams 2, 2'. The first portions 7 of beams 2, 2' each comprise a rectangular hollow section of welded steel in which the second portions 5 and 6 of similar section are mounted for horizontal sliding action so that the two second portions 5 and 6 can telescope in an out of the ends 14 of first portion 7 of each beam 2, 2'. The pair of connectors 4 mounted on each second portion 5, 6 are spaced apart to fit the spacing requirements of known shipping containers such as 9' seen in dotted line to be able to enter and engage with the sockets 95 in corner fittings 8 as described above.

Attached to beams 2, 2' are two longitudinal extending connecting beams 21 which in some versions of the adaptor 50 are not needed but are used here in preference for supporting housing of batteries 40 and control equipment 41. These connecting frames 21 can be made of fixed length or can be telescopic to enable the lifting beams 2 to be moved together or apart to suit differing container lengths. For example, if the spreader 50 is connected to a longitudinally telescopic parent spreader 1, the beams 2, 2' can be brought together or pushed apart by the parent telescopic spreader to suit the length of the containers to be handled by the adaptor 50. When connecting beams 21 are used the spreader 1 may be connected to beams 21 and not beams 2,2' using similar aperture plates 13 to those provided on beams 2,2'.

Figure 2B:
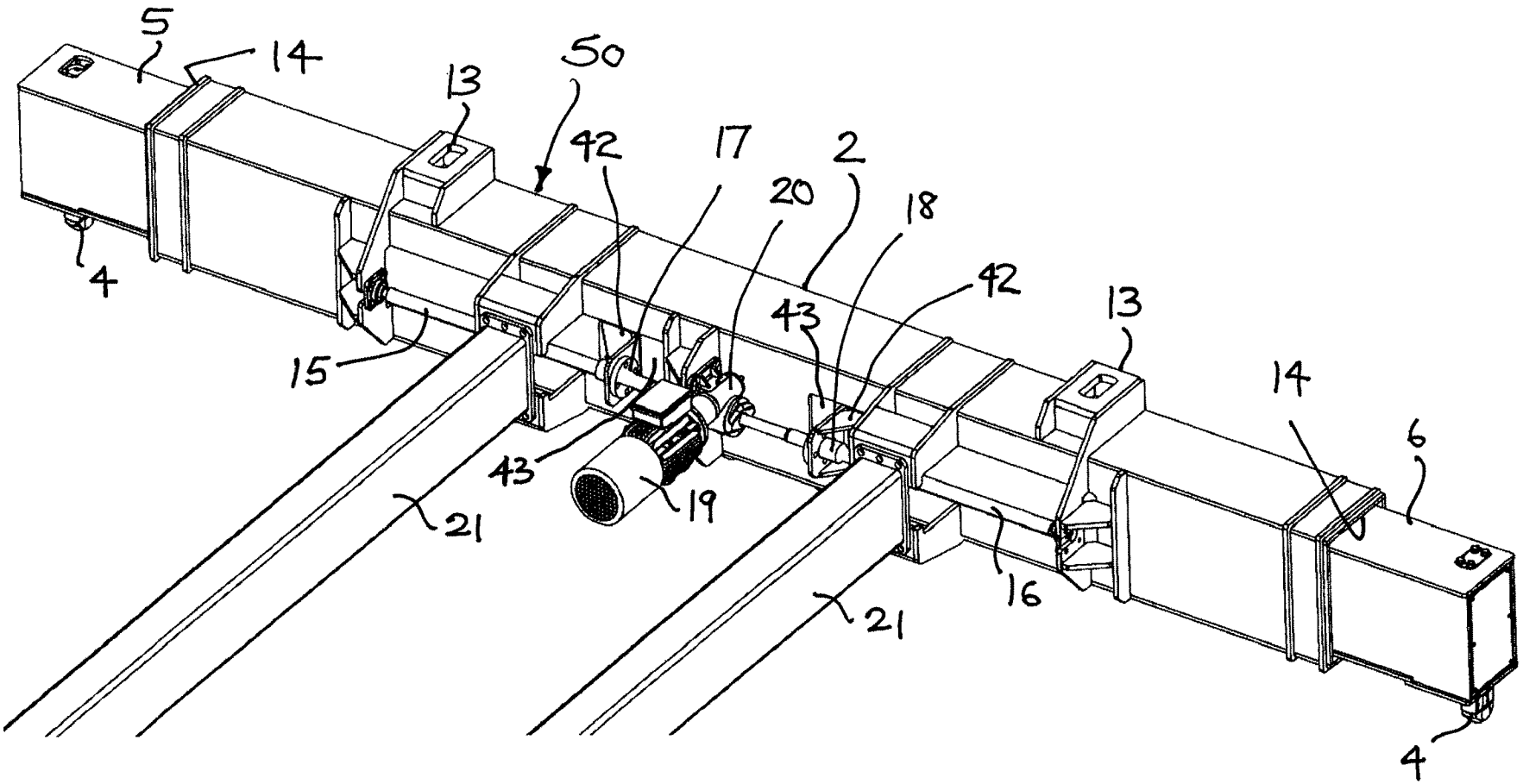
FIG. 2B shows a perspective view of the lifting beam at one end of the adaptor of FIG. 2A looking outwardly from the centre of the adaptor.

In FIG. 2B there is seen a perspective view of one beam 2 of the adaptor 50. To drive the second portions 5, 6 in and out of the first portion 7 an actuator means is provided in the form of screws 15, 16 which are driven for rotation by a motor 19 mounted on a gear box 20 fixed to central portion 7. Nuts 17, 18 are fixed to second portions 5, 6 via brackets 42 which extend through slots 43 in the side of central second portion 7. Thus rotation of the screws 15, 16 within nuts 17, 18 causes the second portions 5, 6 to move horizontally in or out of the central portion 7 enabling the gap A between the containers to be enlarged or narrowed.

Other forms of actuator means can be used to move second portions 5 and 6 in and out of the first portion 7 of beam 2. For example, various other mechanical drives could be used such as rack and pinion gears and chain drives. These could be powered electrically or hydraulically. Alternatively hydraulic rams could be connected between the first portion 7 and the second portions 5 and 6 replacing motor 19, screws 15, 16 gear box 20. The actuators described can be located inside the portions 7, 5, 6 or outside as illustrated. Where a slot 107 is provided for the cell guide blade 106, as described in relation to FIG. 13, then the mechanical drives would of necessity be located back from the slot 107.

The movement of the second portions 5, 6 of beams 2, 2' can be activated in unison so that they travel the same distance relative to the first portion or travel independently if there is provided separate drive systems. Independent activation enables skewed containers in a horizontal plane to be aligned. For example, should pair of containers be skewed not in parallel by for example 100 mm at one end 200 mm at the other, then they can be picked up with the connectors 4 within second portions 5, 6 of each of the beams 2, 2' by causing for example a gap A of 100 mm at beam 2 at one end and say a gap of 200 mm at beam 2' of the other end.

Figure 2C:
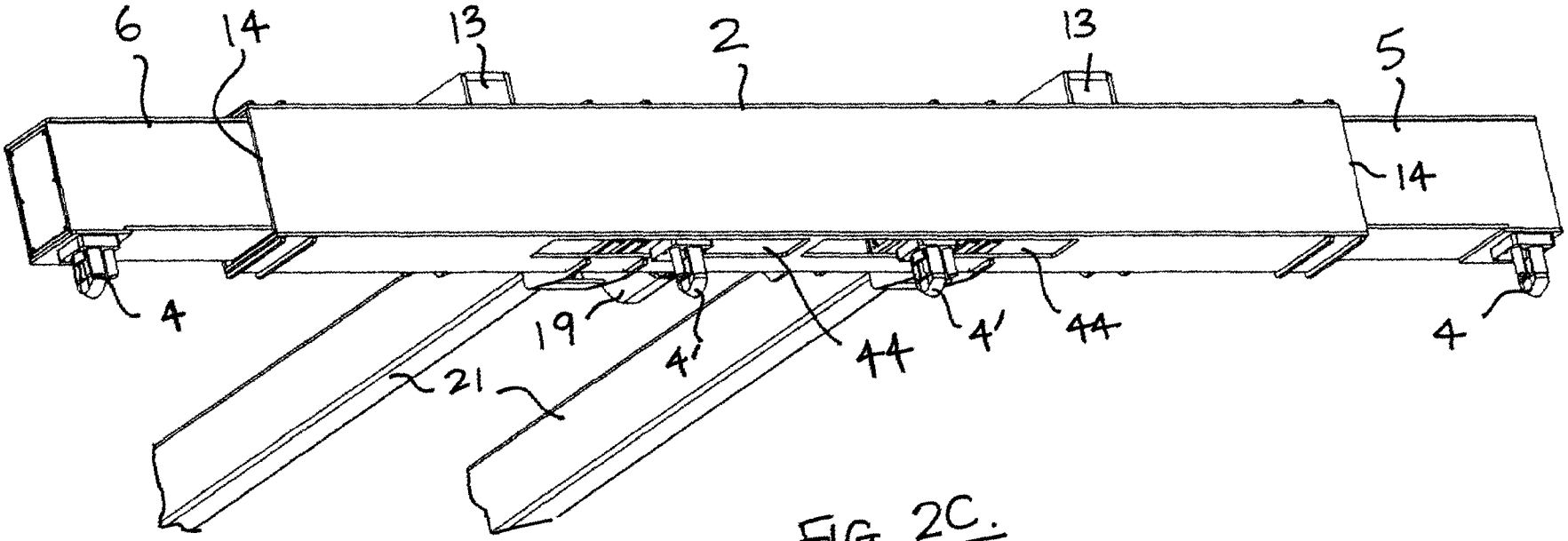
FIG. 2C shows the lifting beam of FIG. 2B looking inwardly towards the adaptor.

In FIG. 2C the underside of lifting beam 2 is seen with the innermost connectors 4' mounted on second portions 5, 6 projecting out of the first portion 7 of beam 2 through slots 44. The outermost connectors 4 project down but are located outside the ends 14 of the first portion 7 of beam 2. As the second portions 5, 6 are deployed in or outwards, the connectors 4, 4' being fixed to them maintain their position on the second portions but are carried to the location desired to engage with the containers at any required gap A. The aperture plates 13 for engaging with the parent spreader are fixed to the beam first portion 7.

Figure 3A:
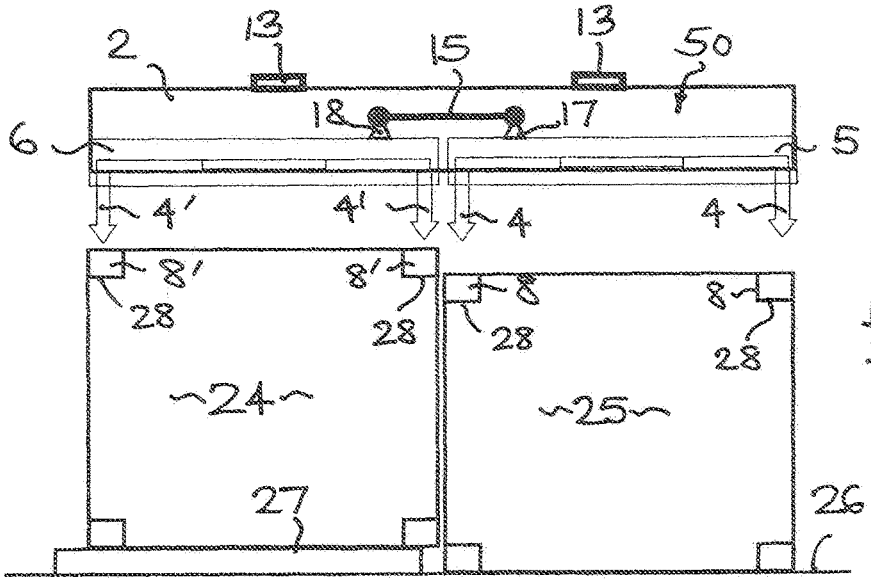
FIGS. 3A to 3C show diagrammatically the lifting sequence used to lift side by side containers positioned at different heights using an adaptor in accordance with the present invention.
Figure 3B:
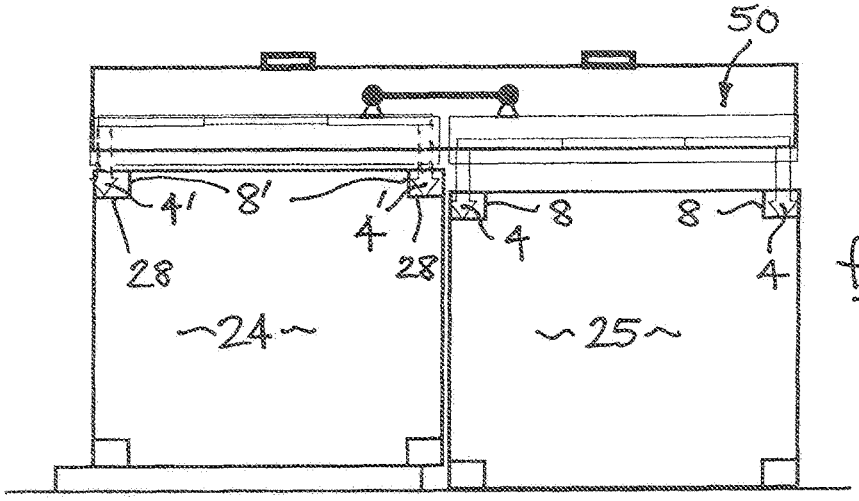
Figure 3C:
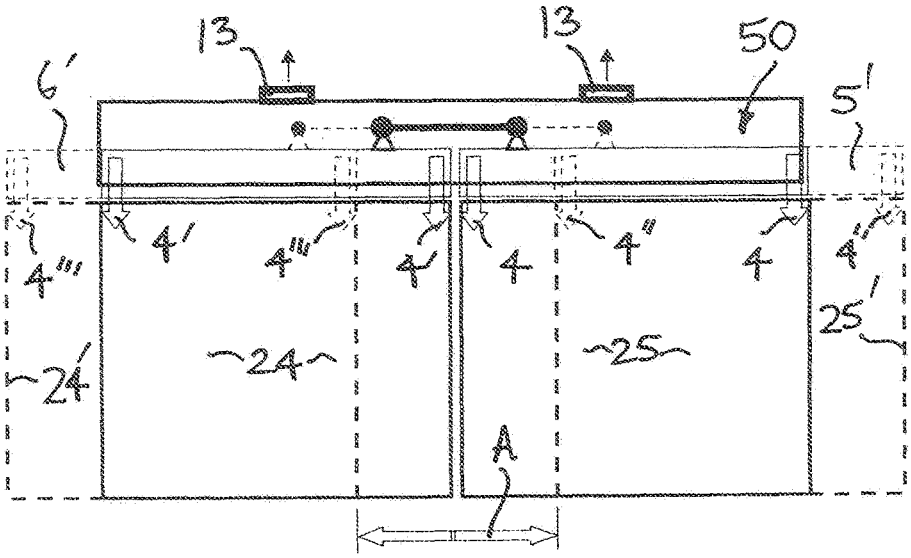

FIG. 3A, 3B, 3C show diagrammatically containers 25, 24 being handled by the adaptor 50. The parent spreader 1 is assumed to be connected to plates 13 but is not shown to simplify the description. In FIG. 3A the container 25 is resting on support 26 and container 24 is resting at a higher level on support 27, the supports being hatch covers, ground, decks or other surfaces with varying heights. So that the beams 2, 2' can engage with the top corner fittings 8 of containers 25, 24 which in this example have the top of container 24 some 60 mm higher than the top of container 25, the connectors 4 are arranged to project an amount of 60 mm more than typical spreader twistlocks and are vertically movably mounted on beams 2, 2'.

In FIG. 3B as beams 2,2' are lowered onto container 24 the connectors 4' enter the corner fittings 8' and on encountering the solid floor 28 of the fittings 8' the connectors 4' are urged upwards into the second portion 6 as indicated by dotted detail 4'. As connectors 4 project down to the lower container 25 and enter its fittings 8 and encounter the floor 28 without being urged upwardly. Thus with the connectors 4, 4' fully inside their fittings 8, 8' they can be rotated about their vertical axes in the manner of all twistlocks and engage with the fittings.

Thus as shown in FIG. 3C, the beams 2, 2' can be raised by the parent spreader 1 through plates 13 with the two containers 24, 25 side by side. In doing so, the connectors 4' now bear the weight of the container 24 and are drawn out of second portion 6 to the bearing position alongside that of second portion 5 and its connectors 4 so that the tops of the two containers 24, 25 are level along with the beams 2,2'.

In this manner, containers can be connected to containers having their tops at different heights and their fittings 8, 8' are able to engage with the vertically movable connectors 4, 4'.

In FIG. 3C the second portions are also seen in dotted detail 5', 6' in positions deployed outwardly from the first portion 7 of the beam 2, 2' so that the containers 24, 25 now lifted off the supports 26, 27 can be parted to gap A with twistlocks at positions 4''', 4'' and containers at 24', 25'.

Figure 3D:
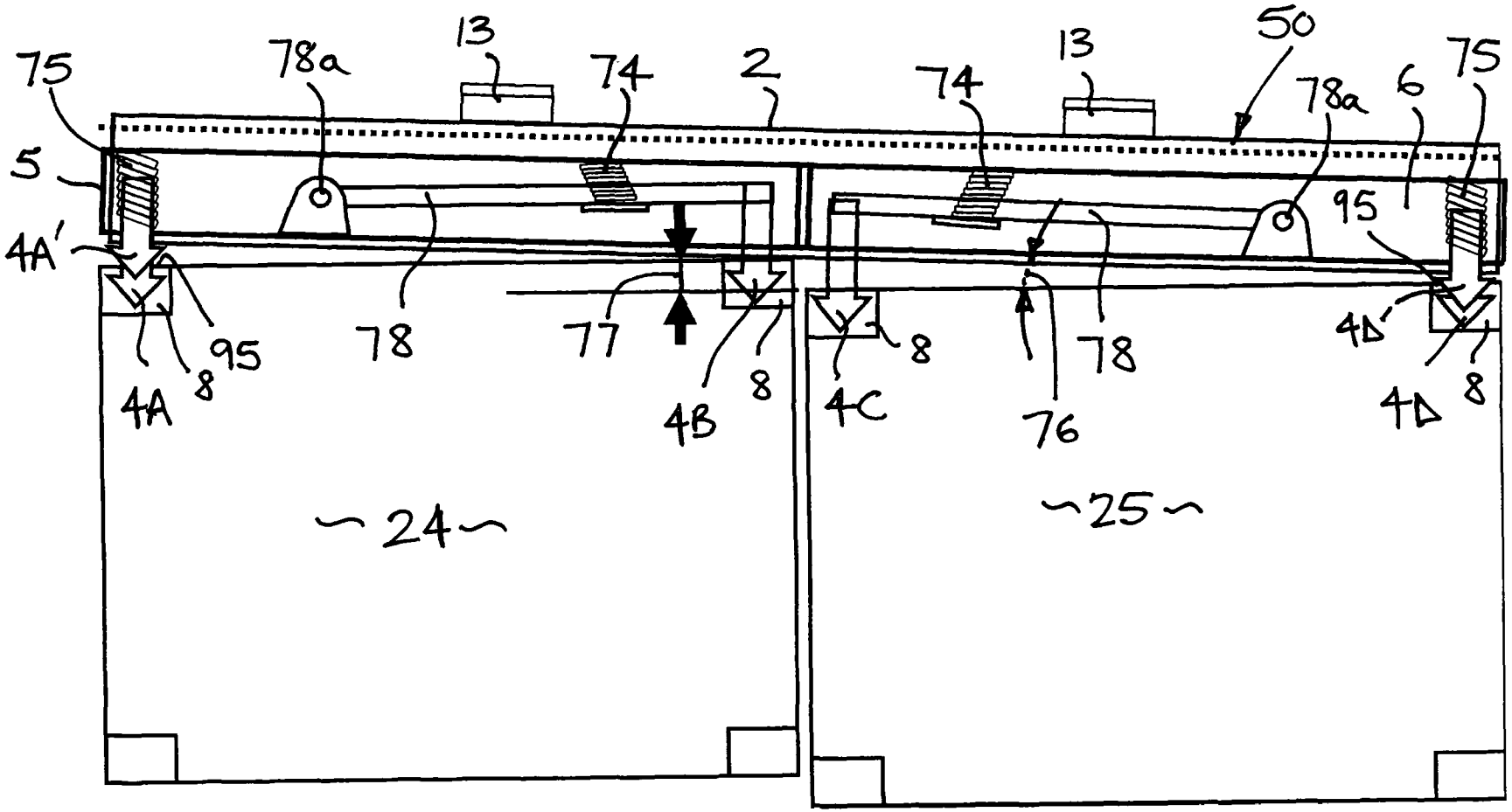
FIG. 3D shows diagrammatically a lifting beam of an adaptor in which its connectors can move relative to the beam to connect with containers at different heights.
Figure 8B:
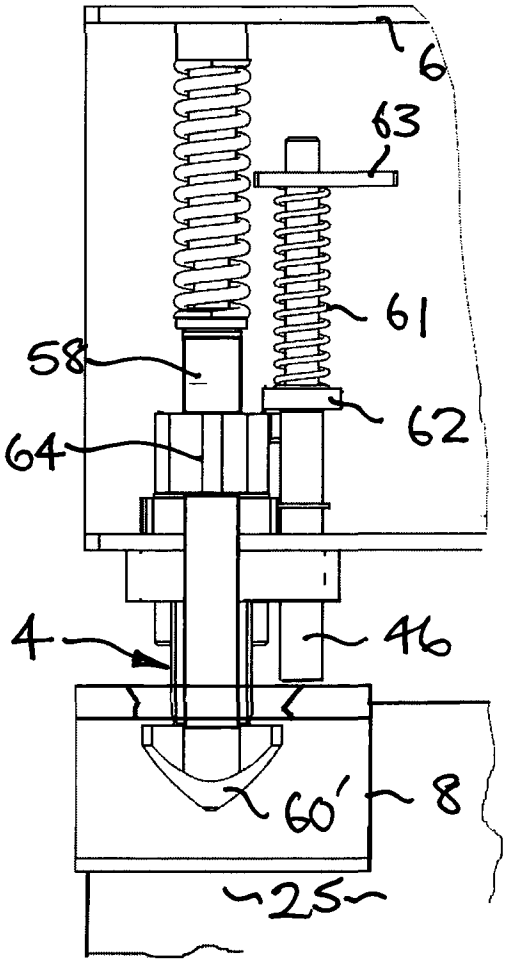
FIGS. 8A and 8B show the operation of a container connector and its associated blocking pin when picking up the lower container in FIG. 3B or FIG. 4.

In FIG. 3D alternative configurations of connectors and second portions can be seen. The tops of the containers 24, 25 are resting at different height 77, and the adaptor has come to rest on the tops of the containers at an inclined angle 76. To enable the connectors 4A, 4B, 4C, 4D to penetrate the sockets 95 in the tops of corner fittings 8 the connectors must all move down to different levels. This can be achieved as illustrated earlier or alternatively as shown in FIG. 3D for example connectors 4A and 4D can be fixed to second portions 5, 6 and enter the sockets or can be spring loaded with springs 75 urging the connectors down from position 4A', 4D' to 4A, 4D. As connectors 4A and 4D are mounted on second portions 5 and 6 and these second portions can move vertically within first portion 7 this provides a certain amount of vertical movement of connectors 4A and 4D during engagement of sockets 95. Connectors 4B, 4C can be mounted on arms 78, the arms being pivotally connected by pins 78*a* to second portions 5, 6 so that they can rise up and down as required, yet urged downward by springs 74 acting between second portions 5, 6 and the arms 78. Blocking pins 46 (not shown here but shown, for example, in FIGS. 8A and 8B below) can be mounted with the moving connectors 4A, 4B, 4C, 4D. Thus by having a combination of fixed and moveable connectors or all four connectors moveable the connectors 4A, 4B, 4C, 4D can penetrate the sockets 95.

Figure 4:
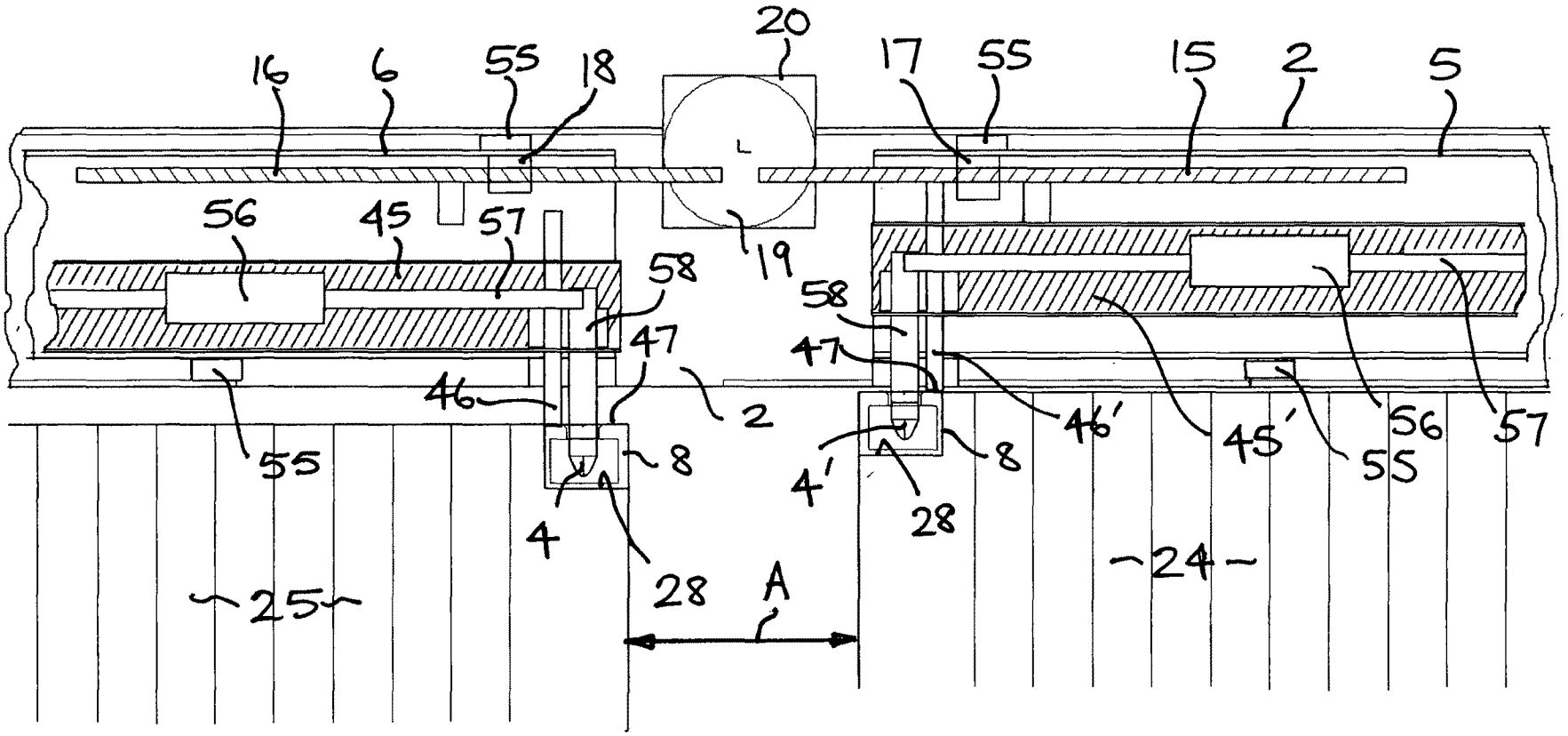
FIG. 4 shows internal details of the central first portion of the lifting beams of FIGS. 2A to 2C showing the actuator means for moving the projecting second portions of the beam relative to the first portion and an actuator arrangement for the connectors for the containers.

In FIG. 4 there is seen a side view of the first portion 7 of the beam 2 cut away to show part of the two second portions 5, 6 mounted inside and the outermost ends of the second portions 5, 6 with their connectors 4' and 4 are not shown. Two containers 25, 24 are seen about to be engaged with the connectors 4, 4' container 24 being supported as before higher than container 25. In this example the connectors 4, 4' are connected to struts 45, 45' so that connectors 4 move vertically with struts 45 and connectors 4' move vertically with struts 45'. Thus as the connectors 4' first encounter the higher container 24 they are pushed up inside beam first portion 7 and second portion 6 displacing the strut 45' upwards as illustrated, for example by 60 mm. Meanwhile the connectors 4 with their strut 45 remain in the down position shown to engage the lower containers 25. Once inside the fittings 8, the connectors 4, 4' can be twisted into the locked position.

To prevent connectors 4, 4' rotating before they are fully inside the fittings 8, there are provided known blocking pins 46, 46' alongside connectors 4, 4' which when fully extended from the bottom of beam 2 prevent rotation of connectors 4, 4', the pins 46, 46' are pushed up into the beam 2 out of the way of the connectors 4, 4' when the pins encounter the top surface 47 of the container fittings 8.

Figure 5A:
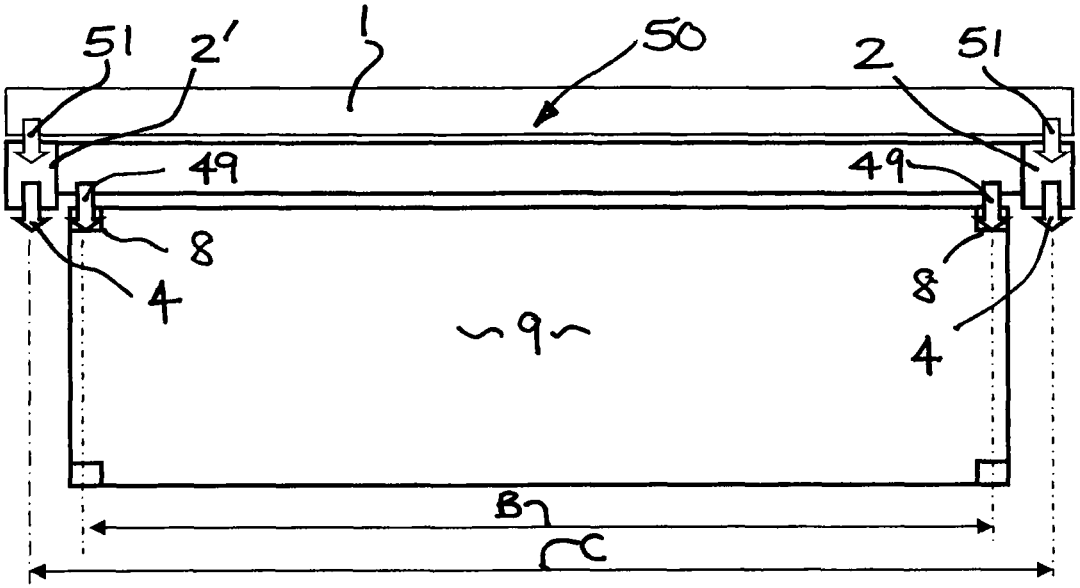
FIGS. 5A and 5B show diagrammatically how a lifting arrangement for lifting containers in a side by side arrangement can be used to lift one or more containers in a central balanced position.
Figure 5B:
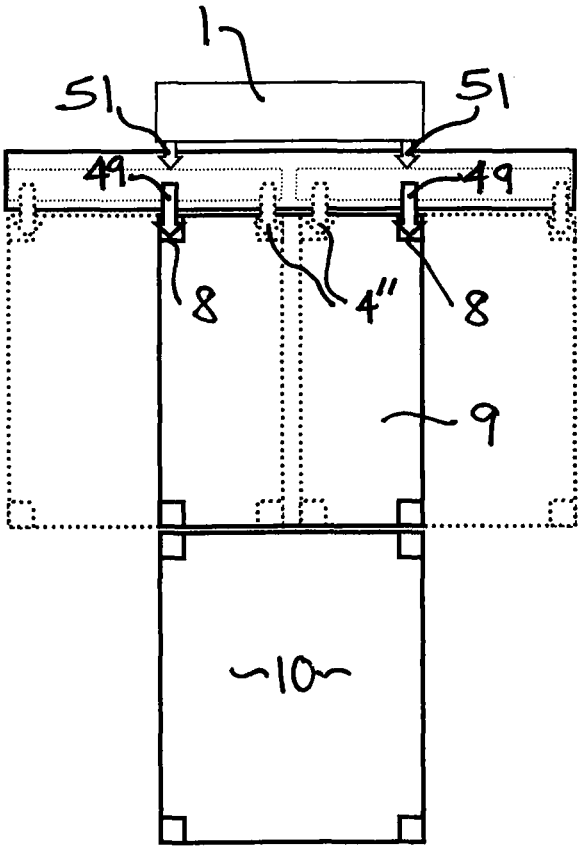

In FIG. 5A there is shown diagrammatically the side elevation of the adaptor 50 being lifted by spreader 1 engaged with its twistlocks 51 into the aperture plates 13 of beams 2, 2'. The spreader 1 has been extended to a length C so that the connectors 4 of the beams 2, 2' are spaced too far apart to engage with the fittings 8 of the containers 9 below. Auxiliary connectors 49 are provided within the adaptor 50 fixed to connecting beams 21 which are located at distance B apart to engage with the fittings 8 of the container 9. These auxiliary connectors 49 are designed not to foul any container lifted normally by beams 2, 2' but to allow a single container or column of containers to be lifted in vertical tandem in a centralised balanced position as more clearly seen in FIG. 5B which shows an end view of the arrangement of FIG. 5A.

Figure 6:
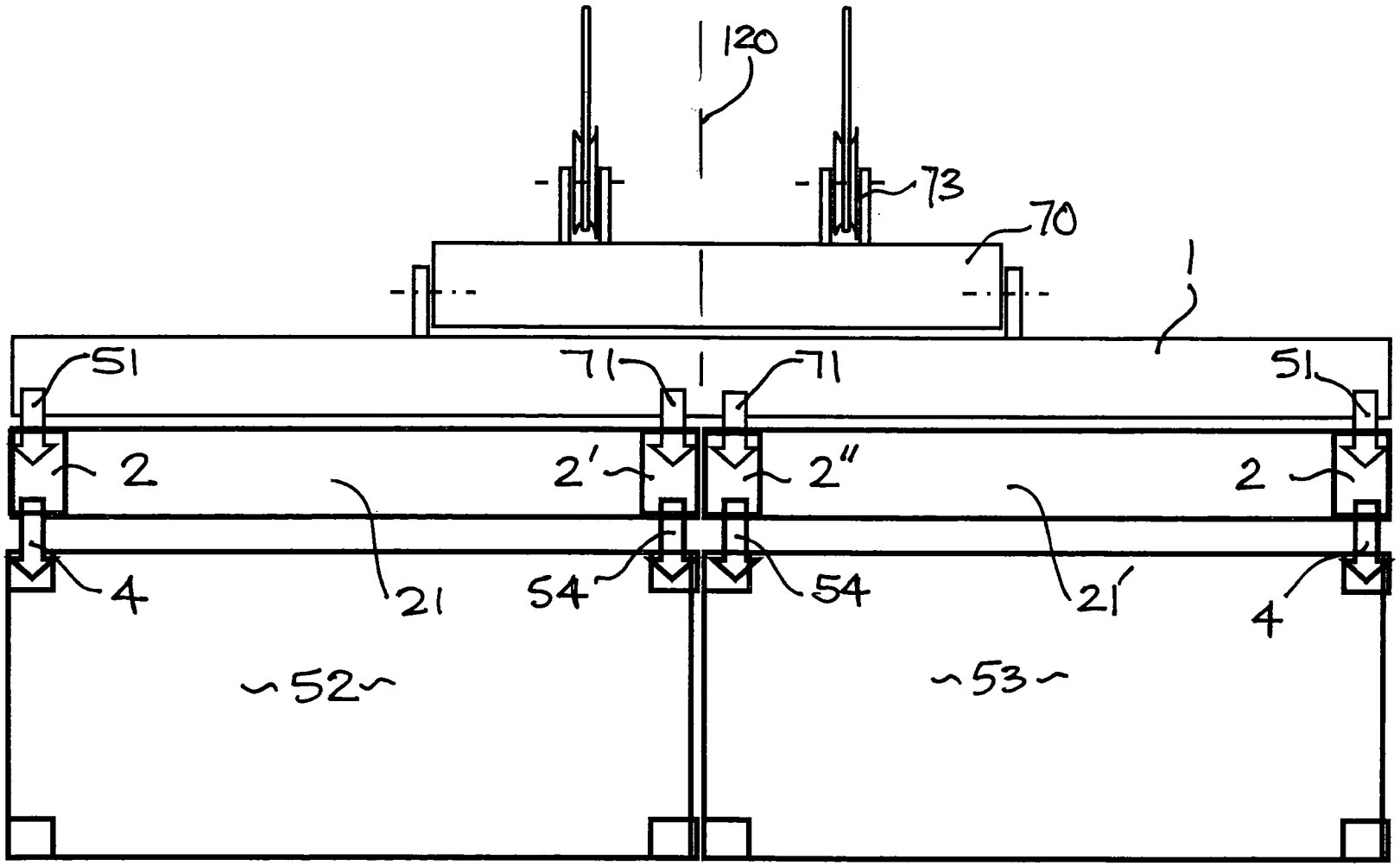
FIG. 6 shows diagrammatically how the arrangement of FIG. 5 can be used to lift containers in longitudinal alignment.

FIG. 6 shows diagrammatically a side elevation of the invention lifting two 20 ft containers 52 and 53 longitudinally aligned end to end. In this arrangement two additional beams 2' and 2" are provided to form two separate assemblies comprising beams 2, 2' and connecting beams 21, and beams 2, 2" and connecting beams 21' which are connected to the containers 52, 53 by inner connectors 54 located near the longitudinal centre 120 of the arrangement and by outer connectors 4 to enable a single lift spreader to lift the two containers 52 and 53 but requiring the spreader 1 to be of the known twin lift type having additional lifting connectors 71 to connect and lift the beams 2' and 2".

It will be appreciated that although the side elevation in FIG. 6 shows two 20 ft containers aligned end to end the single lift spreader or twin lift spreader can now lift two or more columns of containers side by side comprising 8 or more 20 ft containers.

As an alternative to the arrangement shown in FIG. 6 the two beams 21 and 21' can be replaced by a single beam 21 connecting beams 2. In this arrangement no additional beams 2' and 2" are required nor are connectors 71 on spreader 1 and the containers 52 and 53 are supported from spreader 1 via beams 2 and outer connectors 4 on beams 2 and inner connectors 54 near the centre of beam 21.

Returning to FIG. 5A, 5B whereas the connectors 4 are in general controlled and operated together with one instruction, it is envisaged that additional controls would be provided to enable the connectors 49 to be operated independently of connectors 4 or similarly connectors 4" be operated independently of connectors 4.

Figure 7:
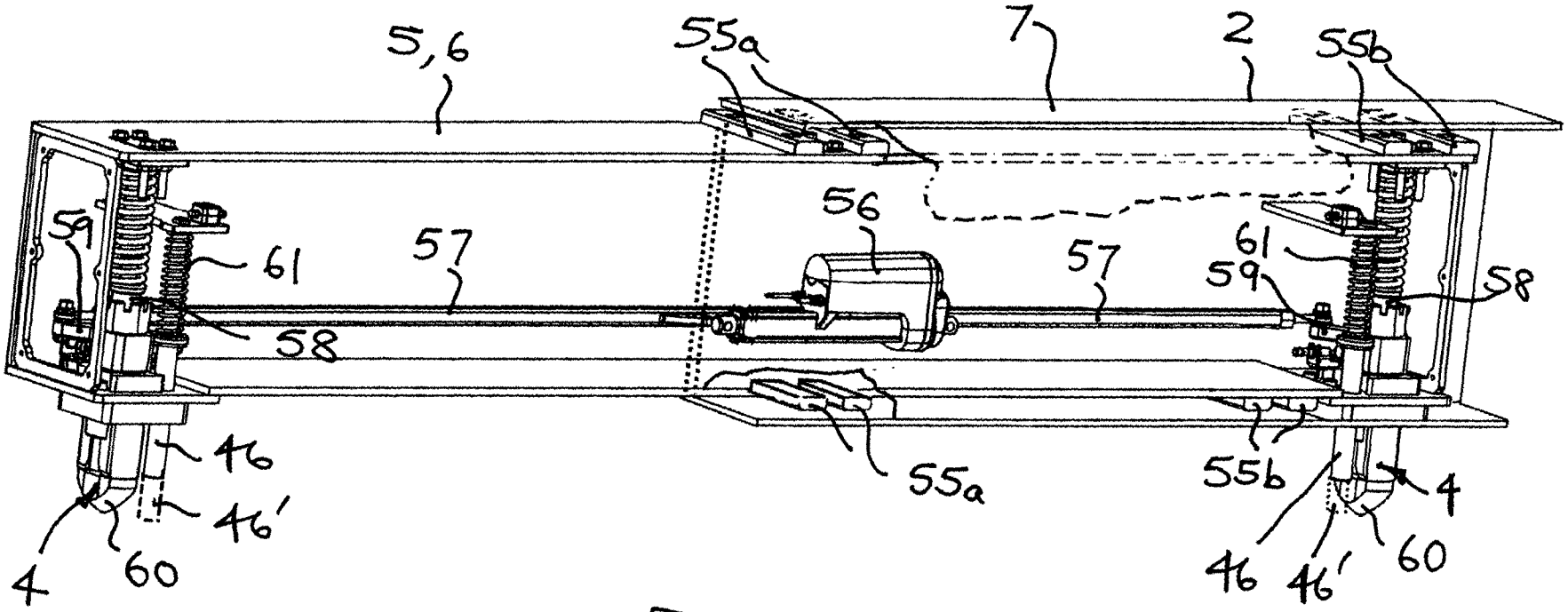
FIG. 7 shows internal details of a lifting beam of an adaptor in accordance with the present invention and in particular the use of low friction support blocks allowing the moving parts of the beam to slide easily relative to each other.

In FIG. 7 there is seen inside the first portion 7 of the beam 2 bearing support blocks 55*a* and 55*b* which support the sliding of second portions 5 and 6 on the inside of beam first portion 7. Support blocks 55*a* at the outer end of first portion 7 of beam 2 are carried on the central portion whereas support blocks 55*b* are secured adjacent the inner ends of the sliding second portions 5 and 6. These support blocks operate as plane bearings and ease the friction which would otherwise occur. The blocks are made of a very low friction plastic compound with a coefficient of friction less than 0.15 and operate dry without any grease or lubricant. Because of the sliding configuration the plane support blocks are self cleaning all of which is important when operating in sandy or salty environments to avoid gumming up of any lubricants that would otherwise be needed. By using these bearing support blocks, the power requirement of the motor 56 and thus energy store of the batteries is significantly reduced thus requiring no power take off from the parent spreader to be used for what is a high power movement during deployment of the containers. For example, the force required to slide each second portion 5,6 with a 10 tonne load suspended from it is of the order of 1500 kg.

Known spreader attachments for over-height cargo locate through apertures similar to plates 13 onto similar beams 2. The parent spreader connectors 51 can be used to rotate and operate the connectors such as 49. However where in the adaptor 50 there are moving second portions 5, 6, such arrangement is not feasible and even operation of connectors 49 is convoluted. The present invention adaptor 50 uses electronic controls with wired and/or wireless communications from crane driver to devices that need operation. So in FIG. 7 there is seen an electrically powered linear actuator 56 (but which can alternatively be a hydraulic ram) to drive the rods 57 outwards and inward and thus operate the cranks 59 which rotate the shaft 58 of connectors 4 and rotate the head 60 or connector 4 into and out of a locked position. Such rotation can only take place when the blocking pin 46 is pushed up as shown and not in it's extended rest position 46' held there by springs 61.

In FIGS. 8A, 8B, 9A, and 9B are show further details of the operation of the twistlock arrangement shown in FIG. 7 when picking up a low level container similar to container 25 as illustrated in FIG. 4.

It is important to be sure that all eight of the connectors 4 are engaged with the corner fittings 8 before the containers start to be lifted. This is achieved by all the connectors being fitted with known blocking pins 46 and with electronic switches that signal to a main control box that they have engaged correctly before lifting. Whereas blocking pins are known and used with connectors such as twistlocks, known twistlocks are mounted only for rotation and not vertical displacement. In this example it is necessary that the plungers 46 can travel vertically with the connectors 4 to allow for container height variations of, for example, +/−50 mm yet release at the point where it is needed for the connector head 60 to be rotated to the locked position 60'.

Figure 8A:
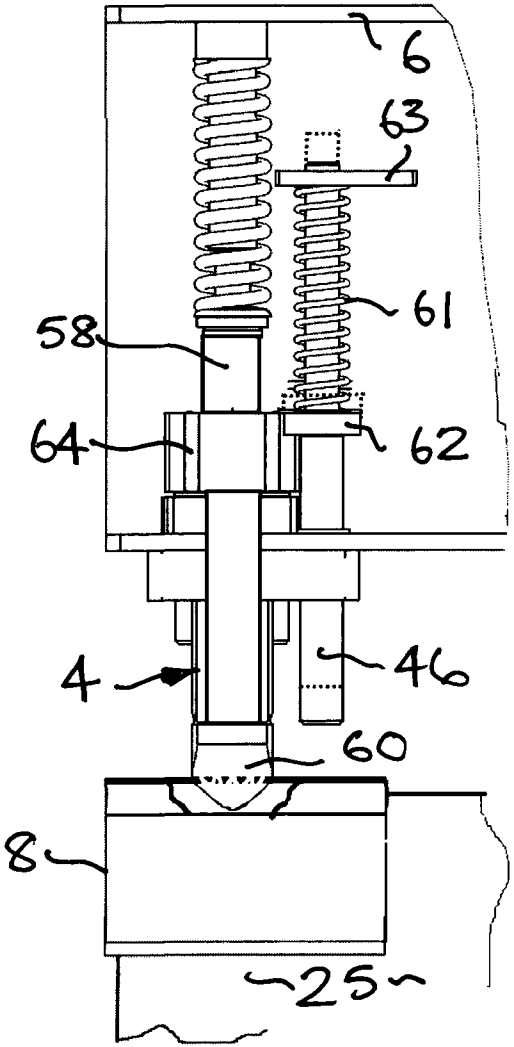

In FIG. 8A the blocking pin 46 is in its extended position held there by a compression spring 61 supported by plate 63 fixed to the second portion 5, 6. Fixed to the plunger is a stop 62 which engages with lobe 64 formed on shaft 58 connected to locking head 60 of the connector 4. The shaft 58 which carries lobe 64 and head 60 cannot rotate when the stop 62 on blocking pin 46 is level with the lobe 64 and engaged with it as shown in FIG. 8A. However when in FIG. 8B the second portion 6 is lowered so that the twistlock head 60 enters the fitting 8 the head 60 can only be rotated to the locked position 60' when plunger 46 has been is pushed upwards to position 46' by the top surface 47 of the fitting 8 so that stop 62 clears the lobe 64 enabling the shaft 58 to be rotated along with the head 60.

Figure 9B:
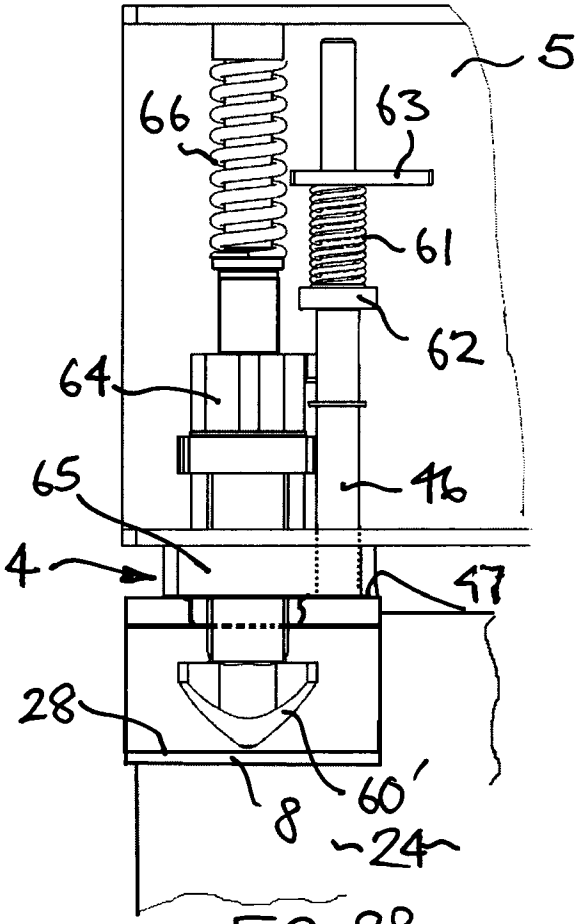
FIGS. 9A and 9B show the operation of a container connector and its associated blocking pin when picking up the higher container in FIG. 3B or FIG. 4.
Figure 9A:
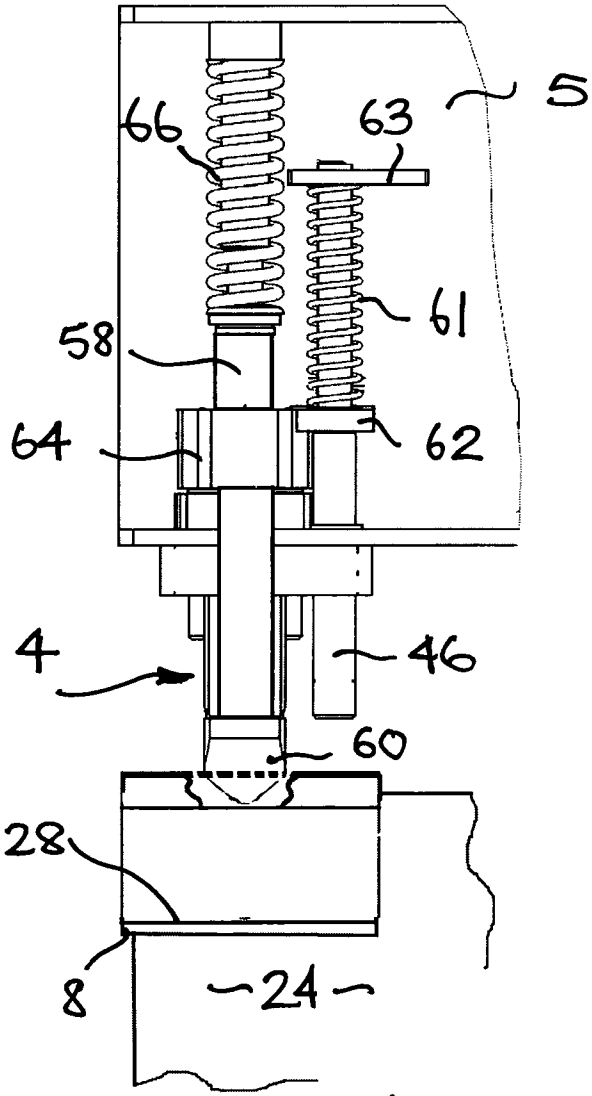

In FIG. 9A, 9B there is seen a container 24 at the higher position and the stop 62 is positioned in FIG. 9A in contact with the lobe 64 as the second portion 5 approaches the fitting 8 in the blocking position preventing the lobe 64 from being rotated. However once the second portion 5 is lowered down further the head 60 encounters the floor 28 of the corner fitting 8 which pushes the connector 4 up compressing its spring 66 which surrounds shaft 58 and carrying the lobe 64 upwards. The blocking pin 46 too is driven upwards by the top surface 47 and once the housing 65 of the connector comes to rest on the top surface 47 of fitting 8 the stop 62 clears the lobe 64 allowing the connector head 60 to be rotated (by the action described around FIG. 7 by actuator 56 and cranks 59 not shown here) and locked in position 60' to allow the container to be lifted via the second portions 5,6.

Figure 10A:
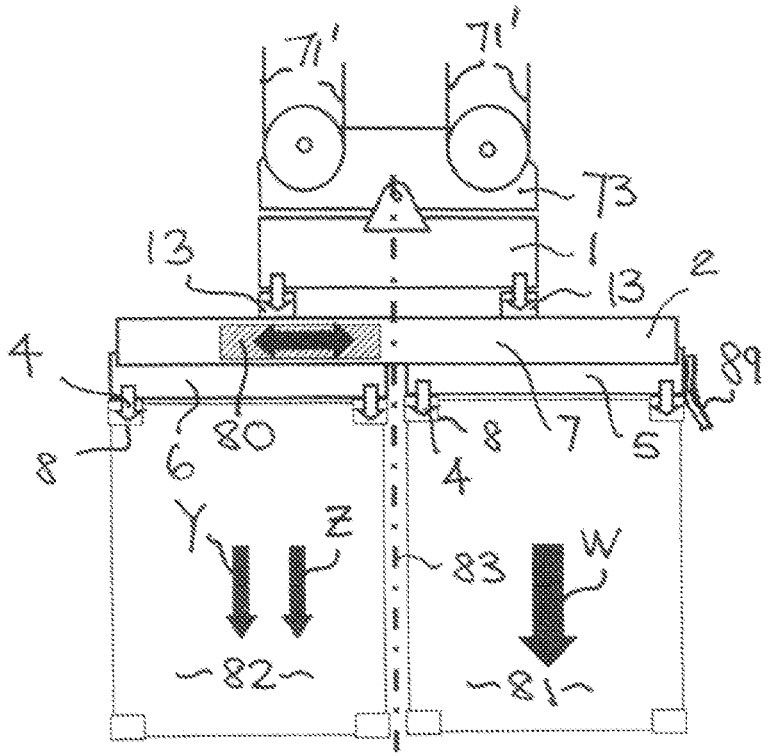
FIG. 10A shows an adaptor with a movable balance weight to enable containers of different weights or in unsymmetrical positions to be lifted by the adaptor.

FIG. 10A shows a beam provided with a movable balance weight 80 with its weight denoted by vertical arrow Z which can be moved along the first portion 2 of beam 50 to balance the beam if container 81 has a heavier weight denoted arrow W than container 82 with light weight denoted arrow Y so that the combined weights W, Y and Z keep the centre of mass acting on central axis 83 under the lifting wires 71' or head block 73. The beam may be provided with weight sensors which can be mounted within the connectors 4 so as to report to a beam control system to work out where the balance weight needs to move to in order to balance the beam for lifting and actions this move.

Alternatively to the balance weight 80, given the data from the connectors 4 of the imbalance, the spreader 1 can be disconnected from a supported adaptor 50 and moved to additional aperture plates 13' located to one side, so that centre of mass axis 83 of the spreader 1 is offset distance V from the geometric centre.

Figure 10B:
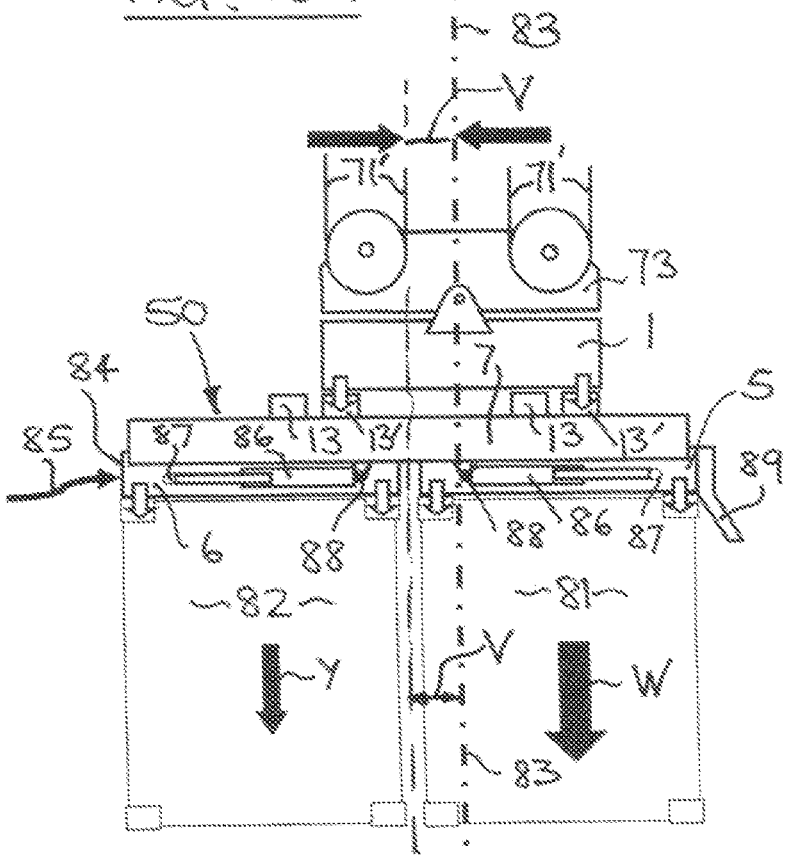
FIG. 10B shows how an imbalance in container weights can be counteracted by connecting the crane spreader to additional aperture plates offset to one side of the centre line of the adaptor.

In operation containers and spreaders impact other containers and solid ships and cranes side by side. If the second portion 5 or 6 of the adaptors 50 impacts such an obstruction the force must be absorbed by the second portion to avoid damage to the second portion, structure and mechanisms in the adaptor. Where hydraulic actuators 86 (see FIG. 10B) are used for telescoping the second portions 5, 6 out, as the end 84 is impacted denoted by arrow 85 the impact force can be taken through the structure of portion 6 through to connecting pin 87 and into actuators 86 restrained by pin 88 where it connects to first portion 7, the impact causing the hydraulic oil in the ram to compress and blowing off its known relief valve thereby cushioning the impact forces. Other cushioning devices can be incorporated between the second portion or portions 5,6 and the first portion 7 such as springs.

Figure 11C:
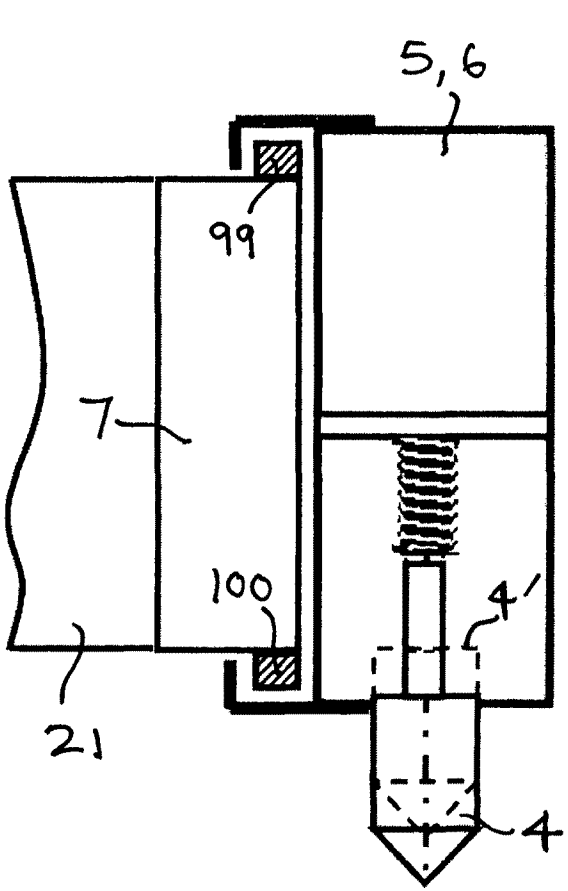
FIGS. 11A to 11C show cross sections through alternative lifting beam arrangements suitable for use in an adaptor in accordance with the present invention.
Figure 11B:
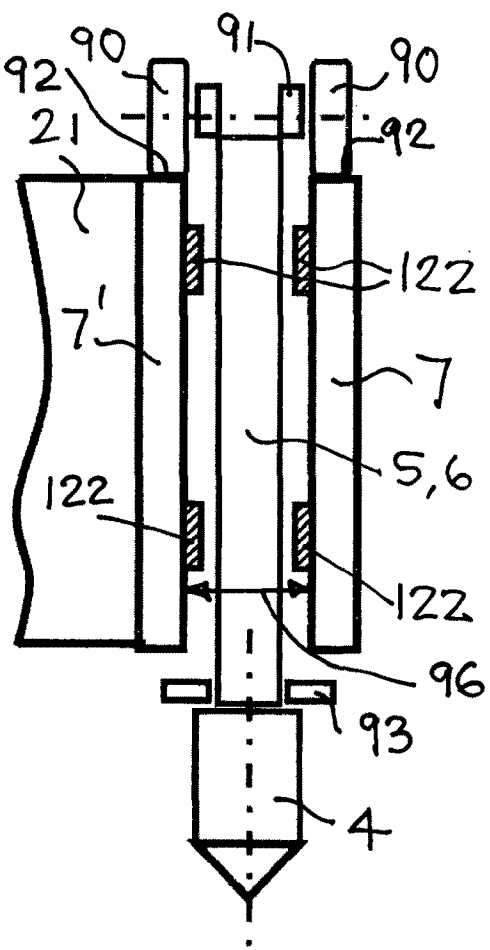
Figure 11A:
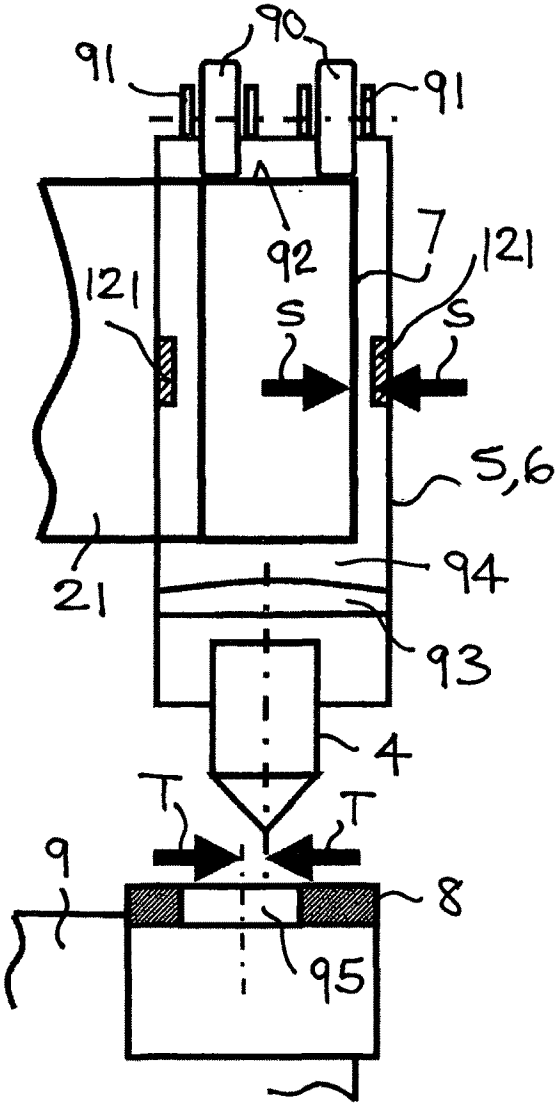

In FIGS. 11A, 11B, and 11C there is seen an end elevation in section of a number of beams showing the connecting beam 21 connected to the first portion 7. In FIG. 11A the second portions 5,6 is mounted to envelope the first portion 7 there being rollers 90 mounted on the second portion via brackets 91 which bear on the top surface 92 of the first portion to enable the second portion to roll along the top surface towards or away from the viewer. In this embodiment, the connectors 4 are fixed for vertical movement to the second portions 5,6. Within each second portion is seen a restrictor 93 fixed inside that controls the clearance 94 between the first portion and second portion so that if the connectors 4 need the weight of the beam and/or connecting beams to bear down on them to urge them into a socket 95 of a corner fitting 8 of a container 9 under gravity the first portion will drop down, close the clearance 94, press on restrictor 93 and press on second portion 5,6 carrying the connectors 4 downwards into the socket 95 of corner fitting 8. As the second first drops down the surface 92 drops away from the rollers 90. However once the connect 4 is engaged with the corner fitting 8 and the first portion lifted upwards, the rollers once again contact the top surface of the first portion and so on until the container is then lifted up with the first portion. The restrictor 93 can be fixed to either the first or second portion and be solid or resiliently biased. Also the second portions 5,6 can move sideways as viewed (i.e. transversely relative to the first portion 7) as indicated by the arrows S in FIG. 11A. This sideways movement S allows connectors 4 to also move sideways as indicated by arrows T which facilitates engagement of connectors 4 in sockets 95 of fittings 8. Similarly, this movement applies to the arrangements illustrated in FIGS. 11B and 11C. Low friction blocks 121 on the inside of second portions 5, 6 protect the first and second portions during sliding of the second portions.

Whereas in known spreaders the connectors similar in size to the connector 4 seen in FIG. 9B have the height space of a beam of similar proportions to portion 7 seen in FIG. 8A, in the present embodiment seen in FIG. 11A the connector 4 must be made compact to fit underneath portion 7.

Figures 16A, 16B:
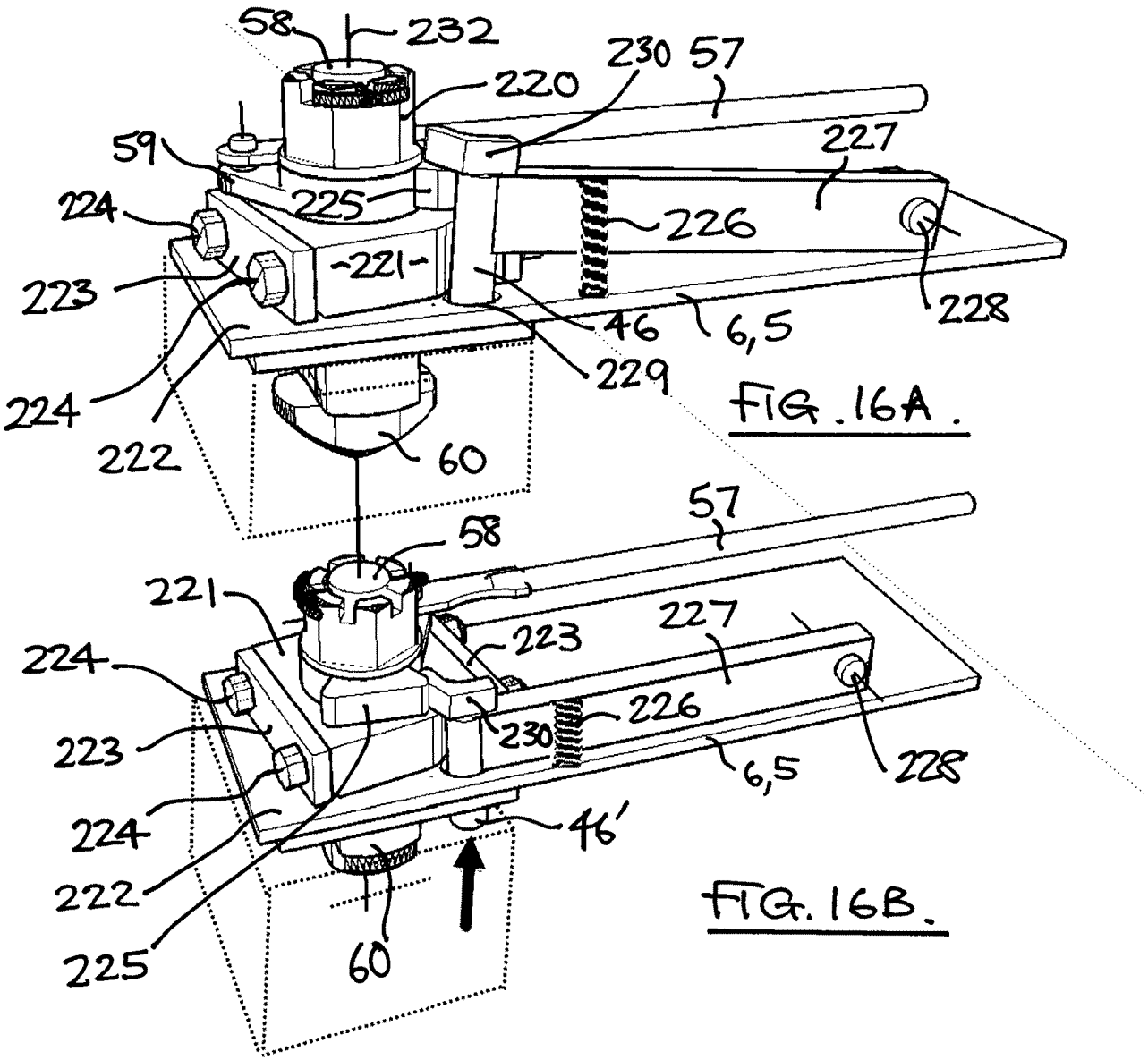
FIGS. 16A and 16B show perspective views of a compact form of connector suitable for use the lifting beam arrangement shown in FIG. 11A.

FIGS. 16A and 16B illustrates how a connector and related blockading pin can be made compact to fit within a small space. The connector 4 is of known construction with head 60, shaft 58, crank 59, rod 57 connected to an actuator not shown. The shaft 58 is threaded to receive a nut 220 so that when a vertical lifting load acts on the head 60, the nut bears down on crank 59 and then on to support 221 which in turn bears on the bottom flange 222 of portion 5, 6. The crank 59 is keyed to the shaft 58 by known means not here illustrated so that they rotate together about axis 232. The support 221 is pinned by bolts 224 to the flange 222 via brackets 223 welded to the flange. The overall height of the connector above flange 222 is minimal and typically about 150 mm and half of typical connector assemblies. Vertical impact loads acting upwards on the head 60 of the connector 4 are taken through the support 221 and thence into the portion 5, 6 via brackets 223.

The mounting of the blockading pin 46 too needs to be compact since the length of the blocking pin 46 in FIG. 9B plus its driving spring 61 take up the full height of portion 5, 6 which would not be feasible for a construction seen in FIG. 11A. So in FIG. 16 the pin 46 is fixed to an arm 227 for arcing movement about pivot 228 urged downwards to the blocking position 46' seen in FIG. 16B by gravity and a spring 226 mounted between arm and flange 222.

In operation a corner fitting of a container not shown pushes the pin 46' upwards as the head 60 of the connector 4 enters the socket 8 of a fitting. The pin 46' is pushed up to position shown in FIG. 16A through guide hole 229 made in flange 222. A cantilevered stop plate 230 is fixed to the arm 227 and seen in FIG. 16B the crank 59 has a projection 225 which is prevented from rotating about the axis 232 of the connector by stop plate 230 thus preventing the twistlock head 60 from rotating to a locked position. However in FIG. 16A the pin 46 is pushed up with the plate 230 freeing the projection 225 so that an actuator can now push on the crank 59 and cause it to rotate the head 60 safely into the locked position. The pin 46 can be seen to be much shorter than earlier embodiments and its spring 226 set at a location within the height of the connector.

In FIG. 11B an alternative embodiment is shown in which the first portion comprises two sections 7, 7' spaced apart by gap 96 through which second portions 5, 6 pass hung from rollers 90 acting on the top surface 92 of the first portion. The operation is similar to that of example 11A with restrictors 93 closing a clearance 94. The weight of the beams being transferred to the connectors 4 via the restrictor 93 resulting in the rollers 90 losing contact with the surface 92 as described above. Low friction blocks 122 on the inside of sections 7, 7' protect the first and second portions during sliding of the second portions 5, 6.

In FIG. 11C there is seen a further embodiment in which the second portions 5, 6 are cantilevered off the outer ends of the first portion 7 so that they move alongside the first portion. Preferably the connectors 4 in this example would be mounted for vertical displacement as described in various embodiments herein. As vertical handling and operational forces act upon the connector 4 and the second portions 5, 6, the second portions are carried by reacting through elongate hooks 97, 98 restrained by rails 99, 100 fixed to the first portion 7. One or more of the faces between the inside of hooks 97, 98 and/or outside of rails 99, 100 are faced with bearing blocks (not shown) so that the second portions 5, 6 can be slid alongside the first portion 7 horizontally whilst under lifting and operational loads through connectors 4.

Figure 12:
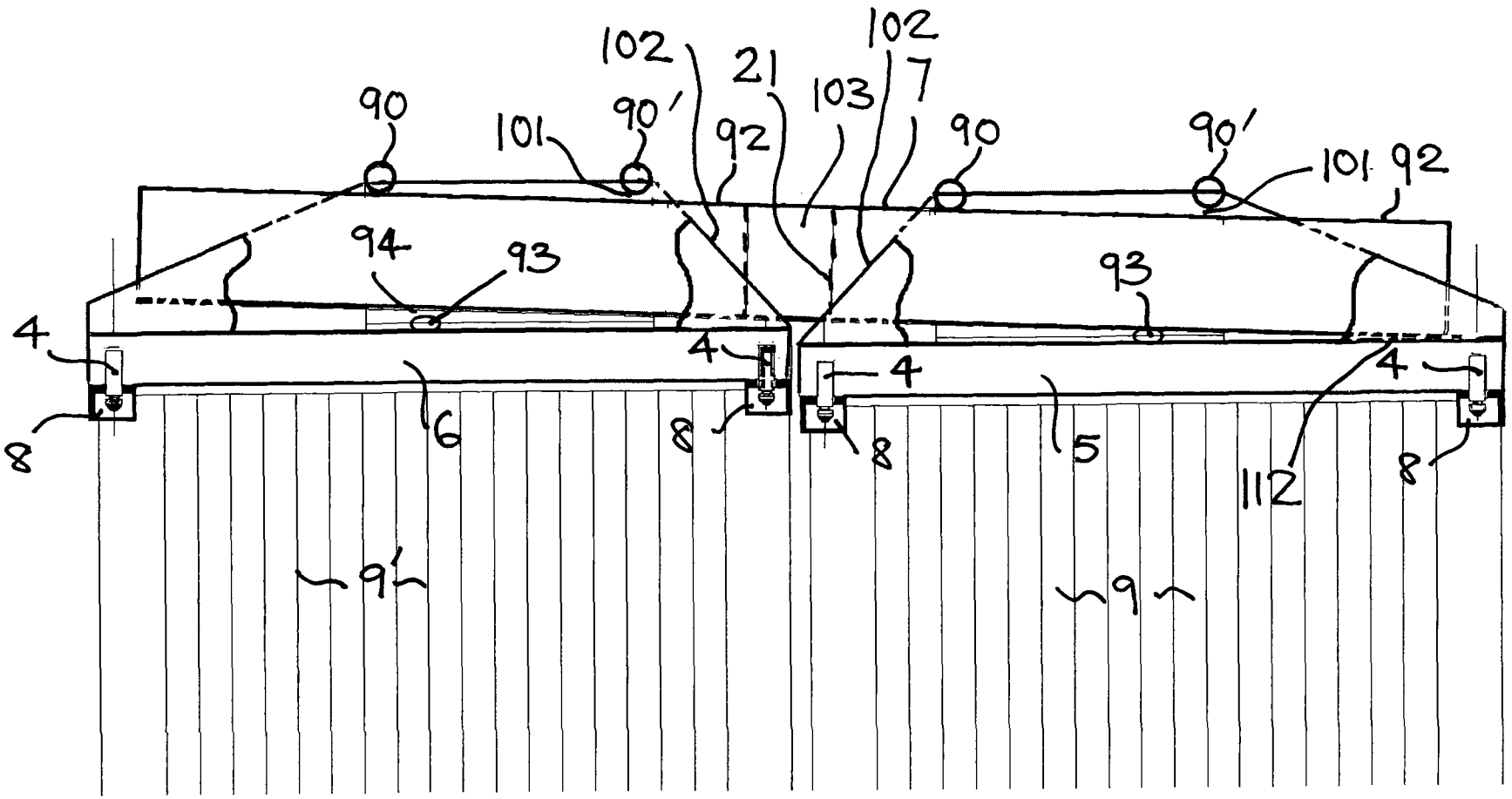
FIG. 12 shows diagrammatically a lifting beam arrangement in which the second portions of the beam slide outside the first portion on rollers engaging the top of the first portion.

FIG. 12 showing a diagrammatic end elevation cut away to reveal inner workings of the example in FIG. 11A with containers 9, 9' attached to connectors 4 through fittings 8. Note that the container 9 on the right is sitting some 60 mm lower than container 9' as happens sometimes in practice so that to engage the four connectors 4 as seen into the four fittings 8, the first portion 7 is tilted down to one side. However because the tops of the containers 9, 9' are substantially horizontal, the second portions 5, 6 lie on top of them under gravity in a substantially horizontal position. The difference in location of first portion 7 and second portions 5,6 causes some or all of the rollers 90, 90' (and/or blocks 55 if provided in the alternative) to remain clear of the top surface 92 of the first portion 7. The clearances 94, 101 are advantageous in allowing the connectors 4 to find an easy location within the sockets 95 of the fittings 8. In the event described around FIG. 11A where gravity is induced to urge a connector into a socket, then one can see illustrated the right hand side of portion 7 urging the restrictor 93 onto portion 5 and thus onto connectors 4. Similarly portion 6 could be urged through the adjacent restrictor 93 by closing clearance 94. Later when lifting first portion 7 to a horizontal position the gaps and rollers and locked connectors and containers all connect up and the containers can be lifted. The second portions 5, 6 have their structure profiled back such as line 102 to expose surface 103 of the first portion 7 thus providing space to. fix connecting beams 21 in dotted line directly to first portion 7. The location of the restrictor 93 is preferably located transversely between the rollers 90 but can be in other places and there can be more than one per beam portion allowing for the restriction in the zone 112 of the second portion.

Figure 13:
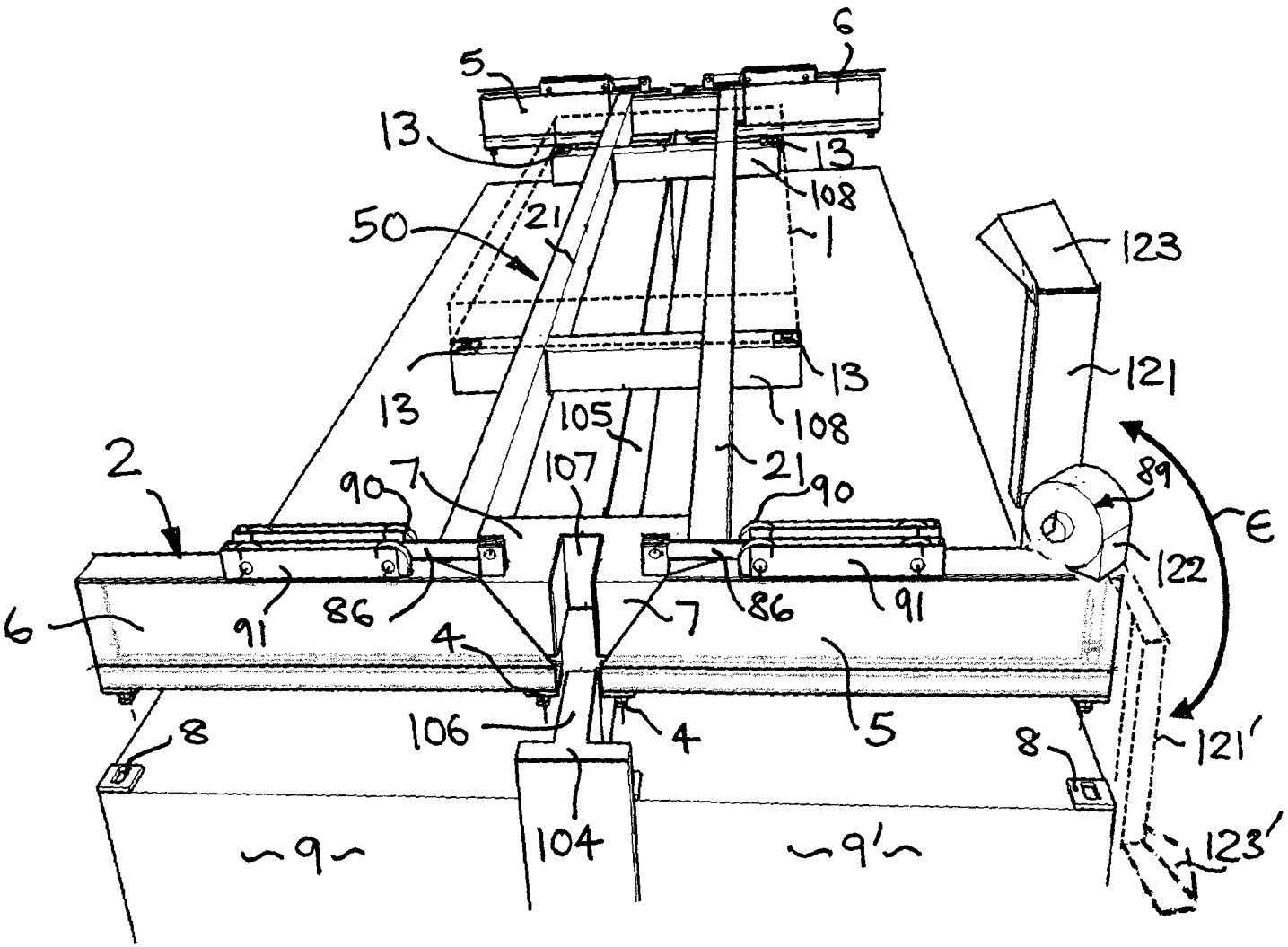
FIG. 13 shows a perspective view of an adaptor in accordance with the present invention in which the lifting beam has a slot to accommodate a cell guide in a vessel's hold.

In FIG. 13 there is seen a perspective view of a preferred embodiment of the adaptor 50 suspended by crane (not shown) and spreader 1 shown in dotted line about to be lowered into the hold of a ship fitted with typical T section cell guides 104 currently supporting two containers 9, 9' the cell guide holding the containers apart by gap 105 equal to the blade 106 of the cell guide. To connect to the containers, the second portions 5, 6 are deployed horizontally outwards driven by actuators 86 acting on the second portions via brackets 91 moving on rollers 90 to match the position of the connectors 4 to the fittings 8 of the containers 9, 9' and to make space for the blade 106 of the cell guide to pass through. In the centre of the first portion 7 there is formed a slot 107 large enough to accommodate the blade 106 so that the adaptor 50 can get to the containers.

In this embodiment there are seen aperture plates 13 built into the connecting beams 21 on cross beams 108 which are located back longitudinally from the beams 2 thus allowing the spreader although aligned transversely with the cell guide 104 to not impact it. A number of different positions and even quantities of the cross beams are envisaged to locate the spreader 1 back from the beams 2 enabling the use of known telescopic spreaders 1 to be used to advantage at nominal positions 20 ft, 25 ft, 30 ft, 35 ft, 38 ft.

A known flipper 89 is seen in its retracted position attached to the end of a second portion 5. The operation of such flippers is typically as follows. There is an arm 121 mounted on a hydraulic or electric motor 122 itself fixed inboard of the corner or end of an adaptor. In this embodiment the flipper is attached not to the first portion 7 but to the ends of the second portion 6 of the adaptor. As known the arm can be rotated through an arc E of about 180 degrees by the motor from a vertical upward facing position as shown recessed within the plan profile of rectangular adaptor 2 to a deployed vertically aligned downward position shown in dotted detail 121' out board of the plan profile of the adaptor. The arm 121' in the down position is shaped with flute 123, 123' flaring perhaps 200 mm outwards so that when lowered over the plan profile of a container 9 to be lifted by the spreader, guides the spreader from an offset misaligned position to an aligned position neatly over the rectangular plan profile of the container until the connectors 4 of the spreader can engage with the sockets 8 in the top of the container 9. Typically there are flippers at at least two corners of the adaptor and sometime flippers located at each corner. However in the present embodiment, it is envisaged that because the second portion can carry the flipper 89 outboard of the containers 9, 9' by some substantial distance, guiding of the adaptor to close proximity of the container can be done with a movement combining the deployment of the flipper arm 121 and horizontally actuation of the second portions. However where two containers are located side by side but with varying gaps between them no flippers can be fitted to locate the second container. To overcome this once the flippers are in contact with the corners of the first container, the second portions are extended or retracted until all connectors locate over the sockets of both containers and the beams lowered to allow them to engage the sockets. Alternatively just one flipper on one corner of one second portion may suffice (as shown in FIG. 13).

Figure 14:
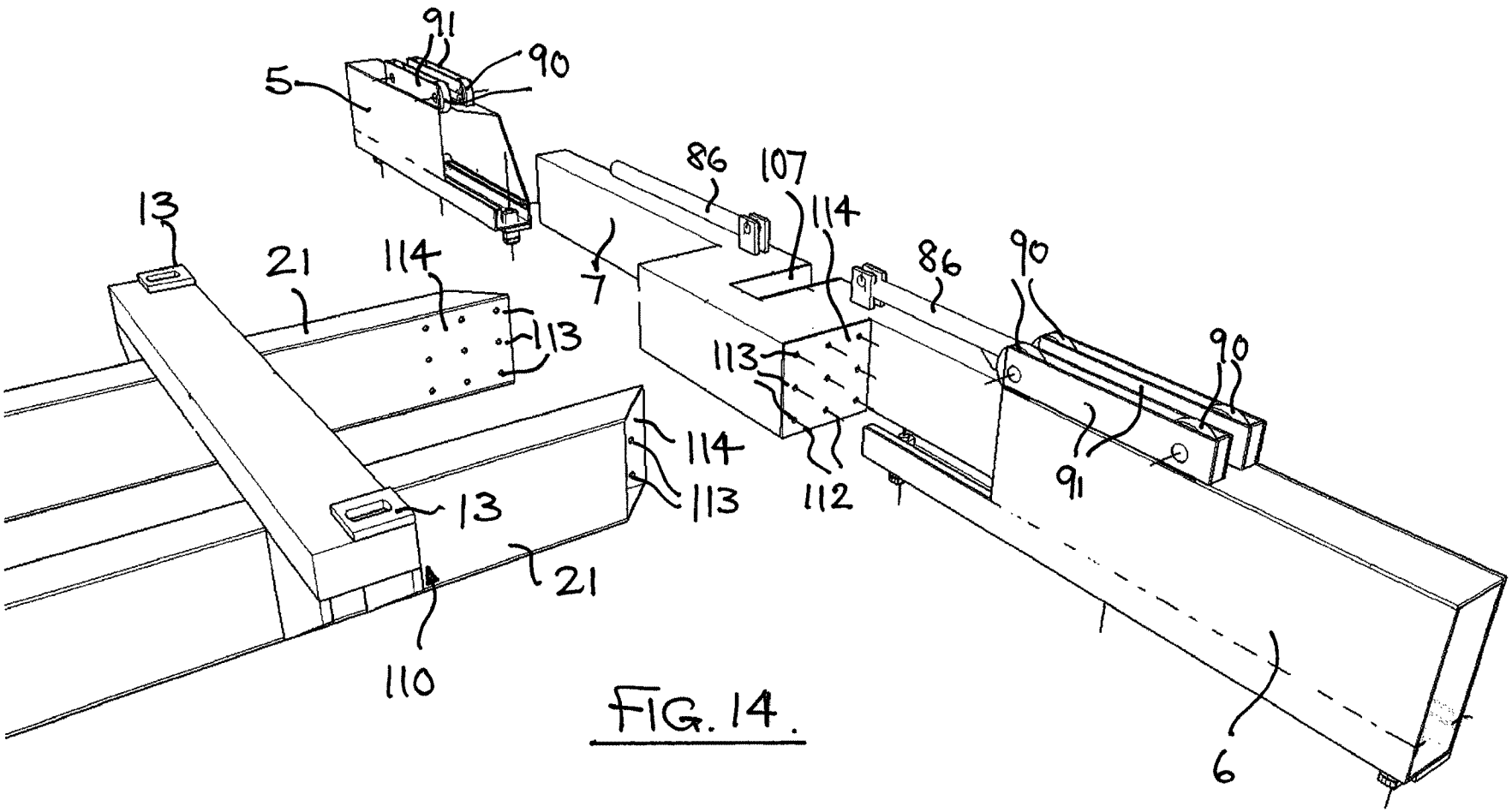
FIG. 14 shows a perspective view of how one end of an adaptor can be made in sub assemblies for transport in a standard shipping container.

In FIG. 14 a detail of the end of the adaptor 50 is seen illustrating how the connection beams 21 form part of an assembly 110 with cross beams 108 and aperture plates 13. The overall length of the assembled adaptor 2 to engage with a 40 ft container is 12192 mm or 40 ft. The overall width across the aperture plates 13 of the assembly 110 need be the same as a spreader 1 (not shown) being 2438 mm too wide to fit width-wise within a standard container doorway for shipping. However turned on its side the assembly 110 will go through a standard container doorway which is some 2550 mm high and is thus able to receive the assembly. The length of the assembly 110 must likewise be less than 12030 mm to fit inside a standard container and so this is truncated at ends 111 to ensure the overall length will fit in a standard container. The other sub-assemblies are small enough to go in a container with the assembly 110 being the second portions 5, 6 and the first portion 7. The first portion 7 must before use be fixed to the assembly 110 and this for example can be done with fasteners 112 passing through an array of aligned holes 113 made in reinforced plates 114 on beams 21 and first portion 7. The adaptor is assembled in the factory and then disassembled for shipping. The fasteners 112 and cooperating holes 113 mean that the first portions 7 and assembly 110 are self jigging, no additional jigs being needed on site to accurately align and bring the assemblies structurally together as designed. Alternatively the adaptor can be aligned with some of the fasteners and then welded together. The plates 114 need not and ideally should not be painted to ensure a tight fitting assembly to be sealant corrosion protected after assembly.

The second portions of the two beams of the adaptor can move independently or be connected mechanically by a drive mechanism (shaft, chain, etc.) connected between one beam and the other passing through, for example, the longitudinal connecting beams if any.

Coordination of the second portions of the beams can be via direct mechanical drives or if driven independently by electronic positioning sensors signalling to a computer control which in turn signals to the drive system to activate the displacement of each second portion. In this way each second portion and connector can be independently controlled or coordinated through computer programming rather than by mechanical design. Furthermore the crane or lifting machine driver may be provided with a control panel which indicates the weight of the containers to be lifted and the gap between them. A tilt detecting device can be used to indicate any off centre tilting of the adaptor and its payload which signals to the drive of the counterbalance weight and urges it one way or the other to move the centre of mass of the adaptor and payload more centrally under the crane frame.

Power can be supplied to the actuators from hydraulic power or electrical power typically available from the parent spreader. However given the low power requirement of the adaptor with its horizontal telescoping second portions this power can also be provided via on board rechargeable batteries carried on the adaptor, charging via mains or solar cells.

Figure 15:
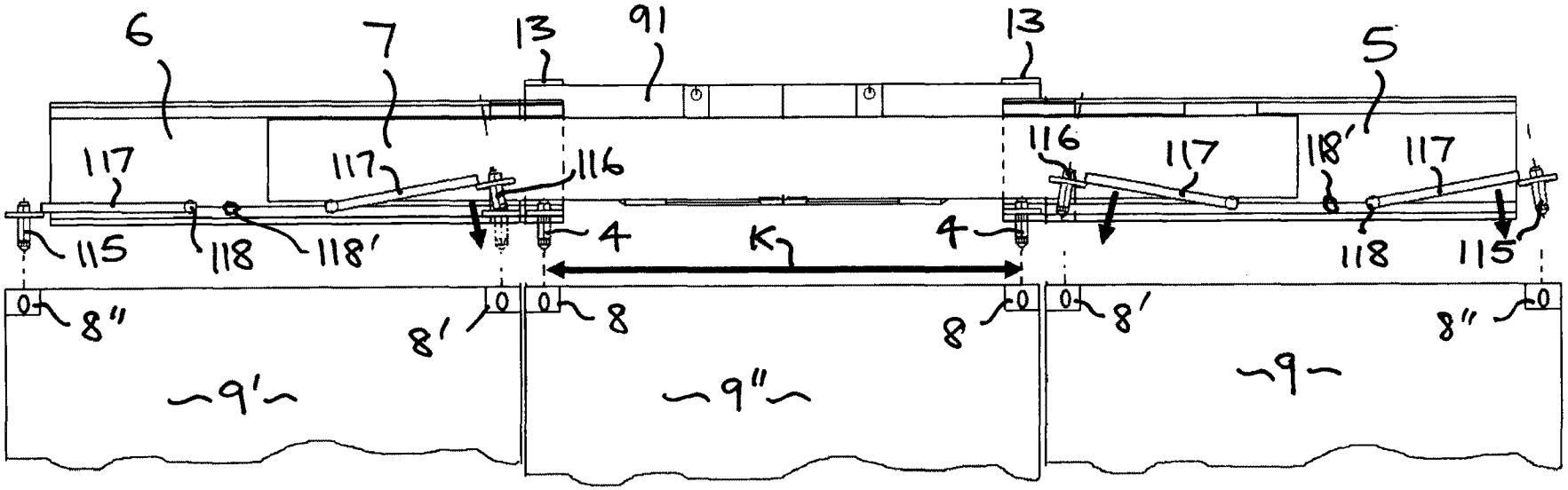
FIG. 15 shows diagrammatically a lifting beam for use in an adaptor in accordance with the present invention which can lift 1, 2 or 3 containers or columns of containers.

In FIG. 15 there is seen the end elevation of the adaptor with 3 containers 9, 9', and 9" awaiting pick up below. The second portions 5, 6 have been extended so that the inboard connectors 4 line up with the top fittings 8 of containers 9". So that containers 9, 9' can be picked up via their inboard corner fittings 8', two additional retractable connectors 116 are provided mounted on pivot arms 117. To connect to the outermost corner fittings 8" of containers 9', 9 connectors 115 are provided mounted on pivot arms 117 via moveable pivots 118 able to be moved from the location shown to location 118'. In this way the location of the two connectors 4 and the connectors 115 and 116 can be adjusted relative to the vertical centre line of the adaptor so that three containers 9, 9', 9" or columns of containers can be picked up side by side as shown in FIG. 15. A single container 9" or column of containers can also be picked up using the inner connectors 4 only which are positioned a distance K apart. Two containers 9, 9' or columns of container can be picked up by raising the retractable connectors 116 and moving the second portions 5 and 6 of the beam inwards on the first beam portion 7 so that containers 9 and 9' can be raised on connectors 4 and 15 when connectors 115 have had their pivots moved to positions 118'.

In an adaptor in which the second portion or portions of the beams are moved relative to the first portions by hydraulic actuator means, the actuator means may also conveniently be used as the cushioning means to absorb any impacts sustained by the second portion or portions during use of the adaptor. Also in such an hydraulically actuated arrangement the mounting of the hydraulic rams on the lifting beam portions may provide at least part of the cushioning means. Further free play in the hydraulic ram mounting may be arranged to allow the first and second portions of the lifting beams to move relative to each other thus easing the entry connectors into the sockets of the corner fittings.

The adaptor may also be provided with one or more cameras which provide a crane or lifting machine operator with a view of the spacing between adjacent containers allowing the operator to adjust this spacing as required during lifting and lowering of the containers by the adaptor.

It will be seen from the above that the adaptor of the present invention is a lightweight container lifting arrangement which can lift containers in a side by side configuration and can vary the transverse spacing of the containers during the lifting procedure to, for example, allow the containers to be straddled by a gantry crane when laid on a quayside or ship's deck. Where existing typical tandem lift spreaders comprise a head block, a carrying frame with connecting beams and cross beams, and two complete individual spreaders again each with beams and connecting beams for connecting to two side by side containers, the adaptor of the present invention can comprise as little as two beams only connected to an existing single spreader thus saving the substantial weight of structural steel.

The adaptor can also lift two or more containers at once and can easily switch to lifting single containers without switching spreaders. The adaptor can connect quickly to existing spreaders or head blocks without need to change them, can be quickly disconnected from a spreader without special training and located on the quayside or on the deck of a ship or stack of containers. The adaptor is also versatile enough to pick up two or more containers side by side and move them sideways to create gaps between them for access and be able to place them on deck supports of differing locations and requires, very little power to be operated particularly when spreading the containers apart so that on board batteries could be used throughout the daily cycle. The adaptor can also be used with known twin-lift spreaders and tandem lift spreaders to further enhance their multi-container lifting capability and even be used in tandem themselves to pick up four columns of containers. The adaptor can be made to navigate above and below deck within cell guides, pick up unbalanced loads in adjacent containers, be suitable for use with automated cranes, require only one longitudinal connecting beam yet lift more than two containers side by side ensuring lightweight low cost construction, and can be shipped to a destination user port in a disassembled form within a known shipping container.

Actuation of the second portions of each beam can be independent of each other enabling the second portions of one beam or one portion of one beam to extend more than the other should two containers not be perfectly aligned in parallel. Similarly actuation of the several connectors can be made independent of each other together with sensing of the position of the blocking pins. With an electronically controlled system, the independent operation and actions and the overruling of the safety signals delivered by position sensors of the various connectors, rams, actuators, blocking pins is envisaged to be achieved by re-programming of the electronic control system, thus not necessarily requiring re-engineering of the mechanisms.

The invention claimed is:

1. An adaptor for lifting two or more shipping containers in a side by side configuration, each container having a top, sides, and ends, with corner fittings provided with lifting sockets, where side by side containers are spaced apart from one another by a spacing, the adaptor comprising:

a first lifting beam; and a second lifting beam;

wherein each lifting beam:

is configured as a continuous telescopically extendable component;

is configured to extend transversely across one end of the top of both of the side by side containers to be lifted; and comprises:

pairs of connectors configured for insertion into the lifting sockets provided in the tops of the side by side containers;

sockets for detachable connection with an associated crane or lifting machine to lift the adaptor and the side by side containers;

a first central portion located between two second outer portions, which portions are movable relative to each other, at least a portion of each second outer portion projecting beyond a respective end of the first central portion; and actuator means connected between the first and second portions so that the second outer portions can be moved relative to the first central portion to vary the effective transverse length of each telescopically extendable lifting beam to enable the spacing between the side by side containers to be varied at one or both ends of the side by side containers.

2. The adaptor according to claim 1, wherein each second portion is moveable inside the first central portion of each telescopically extendable lifting beam.

3. The adaptor according to claim 1, wherein the second outer portions of each telescopically extendable lifting beam move relative to the first central portion on bearings comprising either or both low friction support blocks and rollers.

4. The adaptor according to claim 1, wherein the second outer portions of each telescopically extendable lifting beam are located inside the first central portion with slots formed through the first central portion through which the connectors and associated blocking pins project.

5. The adaptor according to claim 1, wherein the second outer portions of each telescopically extendable lifting beam encircle the first central portion.

6. The adaptor according to claim 1, wherein the second outer portions of each telescopically extendable lifting beam are supported from and alongside the first central portion.

7. The adaptor according to claim 1, wherein the actuator means comprises components selected from the group consisting of mechanical drives, screw jacks, rack and pinion gears, chain drives, and one or more hydraulic rams; and wherein the mechanical drives are powered selected from the group consisting of electric and hydraulic units.

8. The adaptor according to claim 1, wherein the movement of either the first central portion or the second outer portions of each of the telescopically extendable lifting beams and connectors are either coordinated or independently moved under the control of a centralized control function and configured to be controlled and powered independently of control and power of the crane or lifting machine.

9. The adaptor according to claim 1, wherein the connectors are located on a lower surface of the second outer portions of each of the telescopically extendable lifting beams and configured to connect with the lifting sockets in the tops of the side by side containers; and wherein at least one of each pair of connectors is displaceable relative to the second outer portions to pick up adjacent containers whose lifting sockets are either or both at different vertical heights and horizontal orientations.

10. The adaptor according to claim 9, wherein at least one of either or both the connectors and blocking pins of each pair is mounted on an arm which is either or both pivotally and slideably connected to the second outer portions of each telescopically extendable lifting beam from which the connectors are supported;

wherein the adapter further comprises resilient biasing between either or both:

the second outer portions and either or both the at least one connector and the at least one blocking pin; and the arm and the outer portions; and wherein the resilient biasing urges either or both:

the respective connector into the respective socket of the container; and the respective blocking pin into contact with the top of the container.

11. The adaptor according to claim 10, wherein at least one of connectors of each of the second outer portions is displaceable relative to the second outer portions such that, when the second outer portions come to rest on two adjacent containers one of which is either or both vertically and horizontally displaced below the other, each telescopically extendable lifting beam can incline across the containers and heads of the connectors are able to engage with the sockets in the tops of the containers.

12. The adaptor according to claim 1, wherein the actuator means is configured to move the second outer portions and their connected side by side containers apart to one or more of:

allow gaps between hatch covers or projecting items to be avoided when containers are being loaded or unloaded;

avoid cell guides when loading in ships; and allow an additional container to be lifted between the parted side by side containers.

13. The adaptor according to claim 12 further comprising additional connectors on either or both the first central and second outer portions to enable when an additional container is lifted between the parted side by side containers.

14. The adaptor according to claim 13, wherein the second outer portions of each telescopically extendable lifting beam are provided with a first connector at their inner ends, a second retractable connector outboard of the first connector and a third connector at the outer end of each second portion, the third connector being moveable longitudinally relative to each telescopically extendable lifting beam between outer and inner positions so that a container or column of containers can be connected with each second outer portion using the first connector and the third connector in its inner position or the second connector and the third connector in its outer position, and, with the containers supported by the second and third connectors a third container or column of containers can be supported centrally between the other two containers or columns of containers via the first connectors.

15. The adaptor according to claim 1 further comprising a movable balance weight which can be moved along each telescopically extendable lifting beam to balance the respective telescopically extendable lifting beam if containers of different weights or in non-symmetrical positions are to be lifted by each telescopically extendable lifting beam.

16. The adaptor according to claim 15, wherein the connectors for the containers to be lifted are provided with weight sensors which report to a beam control system which works out where the movable balance weight needs to move to in order to balance each telescopically extendable lifting beam for lifting.

17. An adaptor for lifting two or more shipping containers in a side by side configuration, each container having a top, sides, and ends, with corner fittings provided with lifting sockets, where side by side containers are spaced apart from one another by a spacing, the adaptor comprising:

a first lifting beam;

a second lifting beam; and connecting beams which extend between the lifting beams longitudinally relative to the side by side containers to be lifted;

wherein each lifting beam:

is configured as a continuous extendable component;

is configured to extend transversely across one end of the top of both of the side by side containers to be lifted; and comprises:

pairs of connectors configured for insertion into the lifting sockets provided in the tops of the side by side containers;

first and second portions which are movable relative to each other; and actuator means connected between the first and second portions so that the first and second portions can be moved relative to each other to vary the effective transverse length of each lifting beam to enable the spacing between the side by side containers to be varied at one or both ends of the side by side containers;

wherein sockets for detachable connection with an associated crane or lifting machine to lift the adaptor and the side by side containers are incorporated into the group consisting of the first lifting beam, the second lifting beam, the connecting beams and combinations thereof; and wherein one or more:

the second portion of each lifting beam is located inside the first portion with slots formed through the first portion through which the connectors and associated blocking pins project;

the connectors for the containers to be lifted are provided with weight sensors which report to a beam control system which works out where the movable balance weight needs to move to in order to balance each lifting beam for lifting;

the adaptor further comprises additional connectors on either or both the first and second portions to enable when an additional container is lifted between the parted side by side containers; and the adaptor further comprises cushioning means between the second portion or portions of each beam and the first portion of each beam to absorb impacts sustained by the second portion or portions during use of the adaptor.

18. An adaptor for lifting two or more shipping containers in a side by side configuration, each container having a top, sides, and ends, with corner fittings provided with lifting sockets, where side by side containers are spaced apart from one another by a spacing, the adaptor comprising:

a first lifting beam;

a second lifting beam; and connecting beams which extend between the lifting beams longitudinally relative to the side by side containers to be lifted;

wherein each lifting beam:

is configured as a continuous extendable component;

is configured to extend transversely across one end of the top of both of the side by side containers to be lifted; and comprises:

pairs of connectors configured for insertion into the lifting sockets provided in the tops of the side by side containers;

first and second portions which are movable relative to each other; and actuator means connected between the first and second portions so that the first and second portions can be moved relative to each other to vary the effective transverse length of each lifting beam to enable the spacing between the side by side containers to be varied at one or both ends of the side by side containers;

wherein sockets for detachable connection with an associated crane or lifting machine to lift the adaptor and the side by side containers are incorporated into the group consisting of the first lifting beam, the second lifting beam, the connecting beams and combinations thereof;

wherein the lifting beams and connecting beams are made in sub-assemblies; and wherein assembly of the adaptor is facilitated by making the connection between the sub-assemblies of lifting beams and connecting beams self jigging.

19. The adaptor according to claim 2, wherein the second outer portions are supported by the first central portion via bearings or rollers pressing down on the first central portion;

wherein one or more restrictors are provided below the first central portion which allows the second outer portions to move to a higher position relative to the first central portion so that at least one of the bearings or rollers no longer contacts the top of the first central portion enabling the connectors on the second outer portions to align with corner fitting sockets located at different heights; and wherein the first central portion can press down on the second outer portions via the restrictor thus urging the connectors into the corner fitting sockets.

20. The adaptor according to claim 1, wherein there is provided a vertical slot passing through the first central portion of each telescopically extendable lifting beam to accommodate a cell guide in a hold of a cellular container vessel; and wherein the second outer portions of each telescopically extendable lifting beam being moveable apart by the actuator means to clear the slot so that the cell guide can pass through the slot allowing containers handled by the adaptor to be moved freely into or out of the hold of the vessel.

21. The adaptor according to claim 1 further comprising cushioning means between the second outer portions of each telescopically extendable lifting beam and the first central portion of each telescopically extendable lifting beam to absorb impacts sustained by the second outer portions during use of the adaptor.

22. The adaptor according to claim 5, wherein connectors with blocking pins are mounted on arms pivoted on the second outer portions of the telescopically extendable lifting beams and are located vertically below the first central portion of the telescopically extendable lifting beams.

23. The adaptor according to claim 8, wherein the positions of the beam portions are monitored by electronic sensors; and wherein data available from the electronic sensors are fed to the centralized control function for processing to activate the actuator means.

24. The adaptor according to claim 10, wherein at least one of the second outer portions is displaceable longitudinally relative to the side by side containers and the other second outer portion such that longitudinal misalignment of sockets and connectors can be accommodated as they engage.

25. The adaptor according to claim 18 further comprising lifting sockets on an upper surface of the adaptor for connection with a spreader for raising by the crane or lifting machine.

26. The adaptor according to claim 18, wherein an upper surface of the extendable connecting beams are provided with auxiliary lifting sockets for connection with spreaders of different lengths.

27. The adaptor according to 21, wherein the actuator means comprises hydraulic actuator means; and wherein the cushioning means is provided in the hydraulic actuator means.

28. The adaptor according to claim 18, wherein the connecting beams are of fixed or variable length to enable containers of different length to be lifted by the adaptor or shorter containers to be lifted in longitudinal alignment with longitudinally central portions of the connecting beams that have transverse beams connected thereto which extend generally parallel to the lifting beams and which carry connectors configured to connect to at least a portion of the lifting sockets in the top of longitudinally aligned containers or columns of containers.

* * * * *